US011178948B2

(12) United States Patent
McGuire et al.

(10) Patent No.: US 11,178,948 B2
(45) Date of Patent: Nov. 23, 2021

(54) ROLLING COLLAPSIBLE TRAVEL LUGGAGE

(71) Applicant: KARSTEN MANUFACTURING CORPORATION, Phoenix, AZ (US)

(72) Inventors: Brian J. McGuire, Phoenix, AZ (US); Ryan Bruce, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 256 days.

(21) Appl. No.: 16/163,371

(22) Filed: Oct. 17, 2018

(65) Prior Publication Data

US 2019/0045895 A1 Feb. 14, 2019

Related U.S. Application Data

(63) Continuation of application No. 15/000,280, filed on Jan. 19, 2016, now Pat. No. 10,159,318.

(60) Provisional application No. 62/189,598, filed on Jul. 7, 2015, provisional application No. 62/105,636, filed on Jan. 20, 2015.

(51) Int. Cl.

| | |
|---|---|
| ***A45C 7/00*** | (2006.01) |
| ***A45C 5/14*** | (2006.01) |
| ***A45C 13/10*** | (2006.01) |
| ***A45C 13/00*** | (2006.01) |

(52) U.S. Cl.

CPC ..... *A45C 7/0036* (2013.01); *A45C 5/14* (2013.01); *A45C 13/002* (2013.01); *A45C 13/103* (2013.01)

(58) Field of Classification Search

CPC ..... A45C 7/0036; A45C 5/14; A45C 13/002; A45C 13/103

See application file for complete search history.

(56) References Cited

U.S. PATENT DOCUMENTS

| | | | |
|---|---|---|---|
| 385,138 | A | 6/1888 | Reinisch |
| 3,139,164 | A | 6/1964 | Koffler |

(Continued)

FOREIGN PATENT DOCUMENTS

| | | |
|---|---|---|
| CA | 2135081 | 4/1995 |
| CN | 2562627 Y | 7/2002 |

(Continued)

OTHER PUBLICATIONS

GB Search Report dated Jul. 12, 2013 received for related patent Appl. No. GB 1302326.2.

(Continued)

*Primary Examiner* — Tri M Mai

(57) ABSTRACT

A rolling luggage bag includes a cover coupled to a base, the base including a first side opposite a second side and a bottom face extending there between, a first wheel and a second wheel coupled to the base, the first and second wheels configured to rotate about an axis of rotation and separated by a first distance along the axis of rotation, at least a portion of each of the first and second wheels projecting from the first side and from the bottom face, and a third wheel and a fourth wheel coupled to the bottom face, the third and fourth wheels configured to independently swivel about a respective swivel axis and separated by a second distance extending between the swivel axes. When the rolling luggage is in an upright position, the first, second, third, and fourth wheels all contact a surface the luggage bag stands on.

19 Claims, 15 Drawing Sheets

(56) References Cited

U.S. PATENT DOCUMENTS

| | | | | |
|---|---|---|---|---|
| 3,935,931 | A | 2/1976 | Kaplan | |
| 4,063,581 | A | 12/1977 | Williams | |
| 4,674,747 | A | 6/1987 | Mazzocco et al. | |
| 4,679,670 | A | 7/1987 | Wickman | |
| 4,813,520 | A | 3/1989 | Lin | |
| 5,265,894 | A | 11/1993 | Dunn | |
| 5,288,003 | A | 2/1994 | MacDonald | |
| 5,289,906 | A | 3/1994 | Guidi | |
| 5,515,897 | A | 5/1996 | Fehan | |
| 5,660,476 | A | 8/1997 | DeCoster | |
| 5,676,295 | A | 10/1997 | Gelb | |
| 5,975,170 | A | 11/1999 | Anguiano | |
| 6,179,101 | B1 * | 1/2001 | Lin | A45C 13/262 190/103 |
| 6,401,890 | B1 | 6/2002 | Tan | |
| 6,439,585 | B1 | 8/2002 | Tan | |
| 6,520,327 | B1 | 2/2003 | Boardman et al. | |
| 6,533,086 | B1 | 3/2003 | Waddell et al. | |
| 6,557,702 | B1 | 5/2003 | Sanderson et al. | |
| 6,892,773 | B1 | 5/2005 | Wenzler | |
| 7,134,548 | B2 | 11/2006 | Meehan et al. | |
| 7,143,912 | B2 * | 12/2006 | Caneba | A45C 13/262 224/153 |
| 7,434,683 | B1 | 10/2008 | Harper et al. | |
| 7,458,451 | B2 | 12/2008 | Godshaw et al. | |
| 7,780,355 | B2 | 8/2010 | Malloy | |
| 7,849,984 | B2 | 12/2010 | Whalen | |
| 7,975,816 | B1 | 7/2011 | Lin | |
| 8,157,068 | B2 | 4/2012 | Sapyta | |
| 9,681,717 | B2 * | 6/2017 | Meersschaert | A45C 7/0018 |
| 9,999,284 | B1 * | 6/2018 | Tan | A45C 7/0077 |
| 10,159,318 | B2 * | 12/2018 | McGuire | A45C 7/0036 |
| 10,327,523 | B2 * | 6/2019 | Liang | A45C 13/30 |
| 2002/0190490 | A1 | 12/2002 | Yang | |
| 2003/0196860 | A1 | 10/2003 | Be | |
| 2004/0065518 | A1 | 4/2004 | Hoberman | |
| 2005/0034947 | A1 | 2/2005 | Nykoluk | |
| 2005/0284718 | A1 | 12/2005 | Tai | |
| 2009/0255770 | A1 | 10/2009 | Slater | |
| 2011/0083933 | A1 | 4/2011 | Engel | |
| 2013/0213753 | A1 | 8/2013 | Salek | |
| 2015/0053520 | A1 * | 2/2015 | Findlay | A45C 13/03 190/13 R |

FOREIGN PATENT DOCUMENTS

| | | | |
|---|---|---|---|
| EP | 2594152 | A2 | 5/2013 |
| FR | 2906690 | A1 | 4/2008 |
| GB | 2503303 | | 12/2013 |
| WO | 0245540 | | 6/2002 |
| WO | 2006097960 | | 9/2006 |

OTHER PUBLICATIONS

UKIPO First and Second Search Reports for GB 1601026.6, dated Mar. 17, 2016 and Apr. 18, 2016.

* cited by examiner

50e
H6
46d
22
62
50d
42
46c
50c
42
46a
50b
42
50a
46a 58a
42
46c
46b
42a
46a
30
46d
42
42
42

54
42
42
42
26
46c
42
46a
46b
46a
34
46d
42
58b
46c
42
42a
46b
42
H5
H4
H3
H2
H1

ROLLING COLLAPSIBLE TRAVEL LUGGAGE

CROSS-REFERENCE TO RELATED APPLICATIONS

This is a continuation of U.S. Non-Provisional application Ser. No. 15/000,280, filed on Jan. 19, 2016, which claims priority to U.S. Provisional Patent Application No. 62/105,636, filed on Jan. 20, 2015, and U.S. Provisional Patent Application No. 62/189,598, filed on Jul. 7, 2015, all of which are incorporated by reference herein in their entirety.

FIELD OF THE INVENTION

The present disclosure relates to rolling collapsible travel luggage, and more specifically to wheeled travel luggage that is easier to transport when in use, that is collapsible to provide a smaller storage footprint when not in use, and that has an expanded access opening to more easily place and position contents into the luggage.

BACKGROUND

Rolling travel luggage is generally known in the art. However, known rolling travel luggage has certain limitations. For example, existing luggage typically includes three or more swivel caster wheels that allow the luggage to roll in any direction while in an upright position. While convenient, the luggage is susceptible to movement in unintended directions as the only wheels that engage the ground or floor are the swivel caster wheels, with nothing to stop unintended rotation or rolling of these wheels.

As another limitation, existing luggage typically defines an internal chamber by rigid or relatively inflexible side, back and/or front portions. For example, the front side may open away from the remaining rigid sides to provide an access opening to the internal chamber. While the rigid sides provide protection for the contents inside, they inhibit insertion of a large or otherwise bulky object, such as a golf bag containing a set of golf clubs. To place the large or bulky object into the internal chamber, a user must feed the object into the access opening at an oblique or other awkward angle to the luggage. And during insertion, the user may be required to constantly change the angle between the object and luggage to avoid contact with the rigid sides until the object is received in the internal chamber. The constant angle change can be cumbersome, difficult, and awkward for a user.

As yet another limitation, some types of existing luggage include side wheels and a handle provided at a top portion of the luggage. A user grasps the handle, tilts the luggage to engage the side wheels with the ground, and is free to roll the luggage in the tilted position. The majority of the luggage load, however, is transferred to the user through the top handle, leading to strain on the arm, wrist, and/or forearm of the user.

SUMMARY OF THE INVENTION

A rolling luggage bag includes a cover coupled to a base, the base including a first side opposite a second side and a bottom face extending there between, a first wheel and a second wheel coupled to the base, the first and second wheels configured to rotate about an axis of rotation and separated by a first distance along the axis of rotation, at least a portion of each of the first and second wheels projecting from the first side and from the bottom face, and a third wheel and a fourth wheel coupled to the bottom face, the third and fourth wheels configured to independently swivel about a respective swivel axis and separated by a second distance extending between the swivel axes. When the rolling luggage is in an upright position, the first, second, third, and fourth wheels all contact a surface the luggage bag stands on.

A collapsible luggage bag includes a back portion connected to a first side portion and a second side portion, a front flap removably connected to the first side portion, the second side portion, and the back portion by a connection member, and a base connected to the back portion, the first side portion, the second side portion, and the front flap. The first and second side portions pivot away from each other about respective folds between the respective side portion and the back portion when the front flap is removed.

Other features and aspects will become apparent by consideration of the following detailed description and accompanying drawings.

Figure 1:
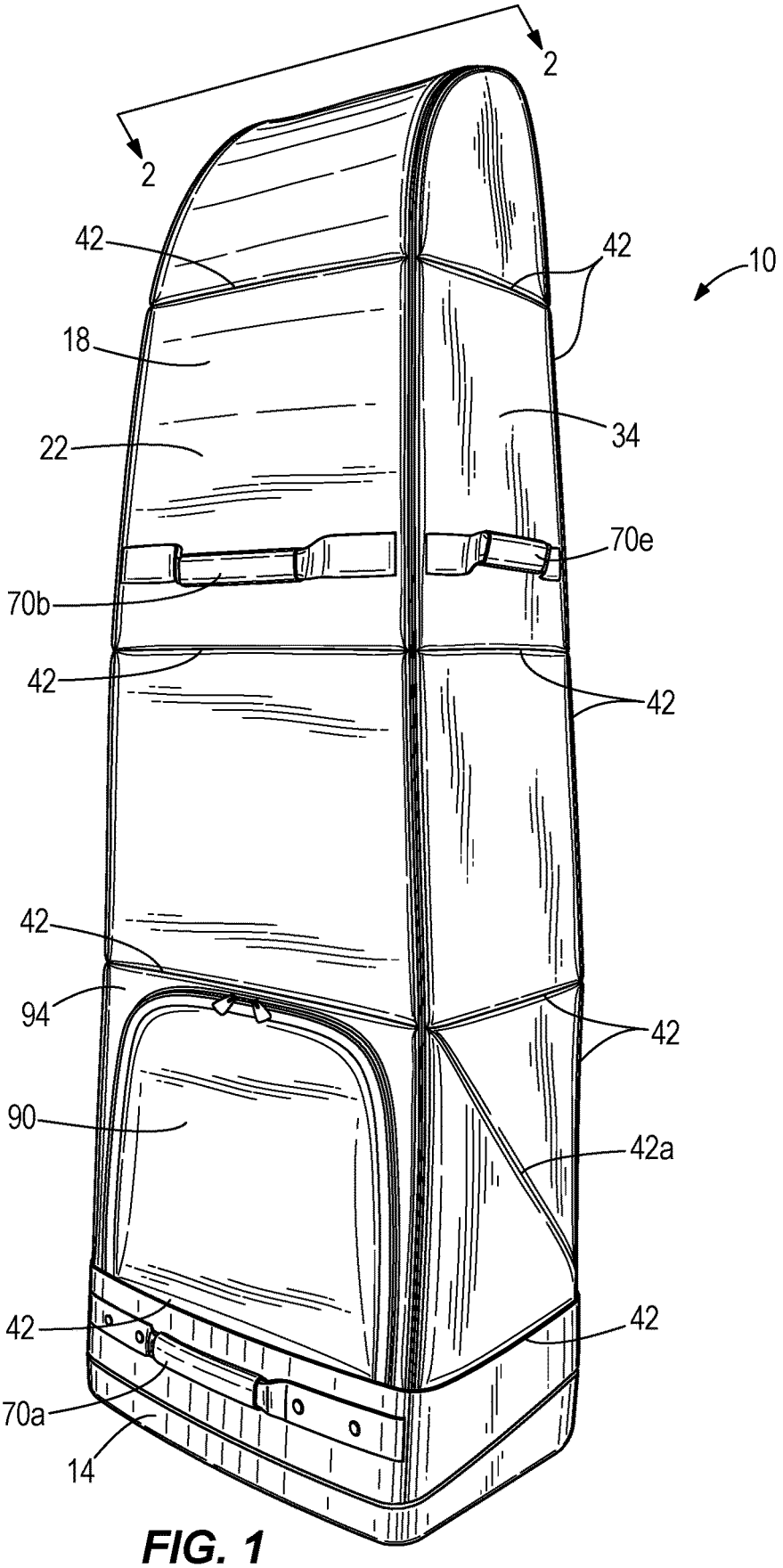
FIG. 1 is a perspective view of a rolling collapsible travel luggage bag in an upright position.

Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

For ease of discussion and understanding, and for purposes of description only, the following detailed description illustrates a rolling collapsible travel luggage bag 10 as an elongated luggage bag suitable for transporting large items, such as a golf bag, golf clubs, and one or more golf accessories. The golf bag is of a size suitable to carry a plurality of full length golf clubs, for example a set of golf clubs that includes a combination of one or more of a driver, a wood, a hybrid, an iron, a wedge, and/or a putter. A full length golf club is not collapsible, and has a length of approximately 32 inches to approximately 49 inches, depending on the club. An example of a large golf accessory includes a full length golf umbrella, which has a length of approximately 36 inches to approximately 48 inches, and opens to an arc or canopy size of approximately 50 inches to 68 or more inches. It should be appreciated that the elongated luggage bag is provided for purposes of illustration and aspects of the luggage bag 10 disclosed herein may be incorporated into luggage of any size, shape, or orientation.

FIG. 1 illustrates a rolling collapsible travel luggage bag 10. The luggage bag 10 includes a base 14 connected to a collapsible cover 18. As illustrated in FIGS. 2-6, the collapsible cover 18 includes a front portion or front flap 22, a back portion or back flap 26, a first side portion or flap 30, and a second side portion or flap 34. The front portion 22 is oriented opposite the back portion 26, and the first side portion 30 is oriented opposite the second side portion 34. In addition, the back portion 26 preferably is connected or otherwise integrally formed as one piece with the first and second side portions 30, 34. The front portion 22 may have a selectively removable connection to the back, first side, and second side portions 26, 30, 34 to open or provide access to the interior chamber of the luggage bag 10. The selective removable connection between the front portion 22 and back, first side, and second side portions 26, 30, 34 may provide different degrees or amounts of access to the interior chamber of the luggage bag 10. Stated otherwise, the removable connection may provide an opening or partial opening to the interior chamber. For example, the selectively removable connection may be formed by a zipper having a pair of sliders 100*a*, 100*b* that meet in a closed position at the top or end of the luggage bag 10 opposite the base 14 (see FIGS. 4A-B). The sliders 100*a*, 100*b* may be moved along the zipper in opposite directions along a portion of the zipper to provide partial access to the interior chamber, such as a first standing access position shown in FIG. 8, or entirely along the zipper to provide maximum access to the interior chamber, such as a second access position shown in FIG. 9.

Figure 16:
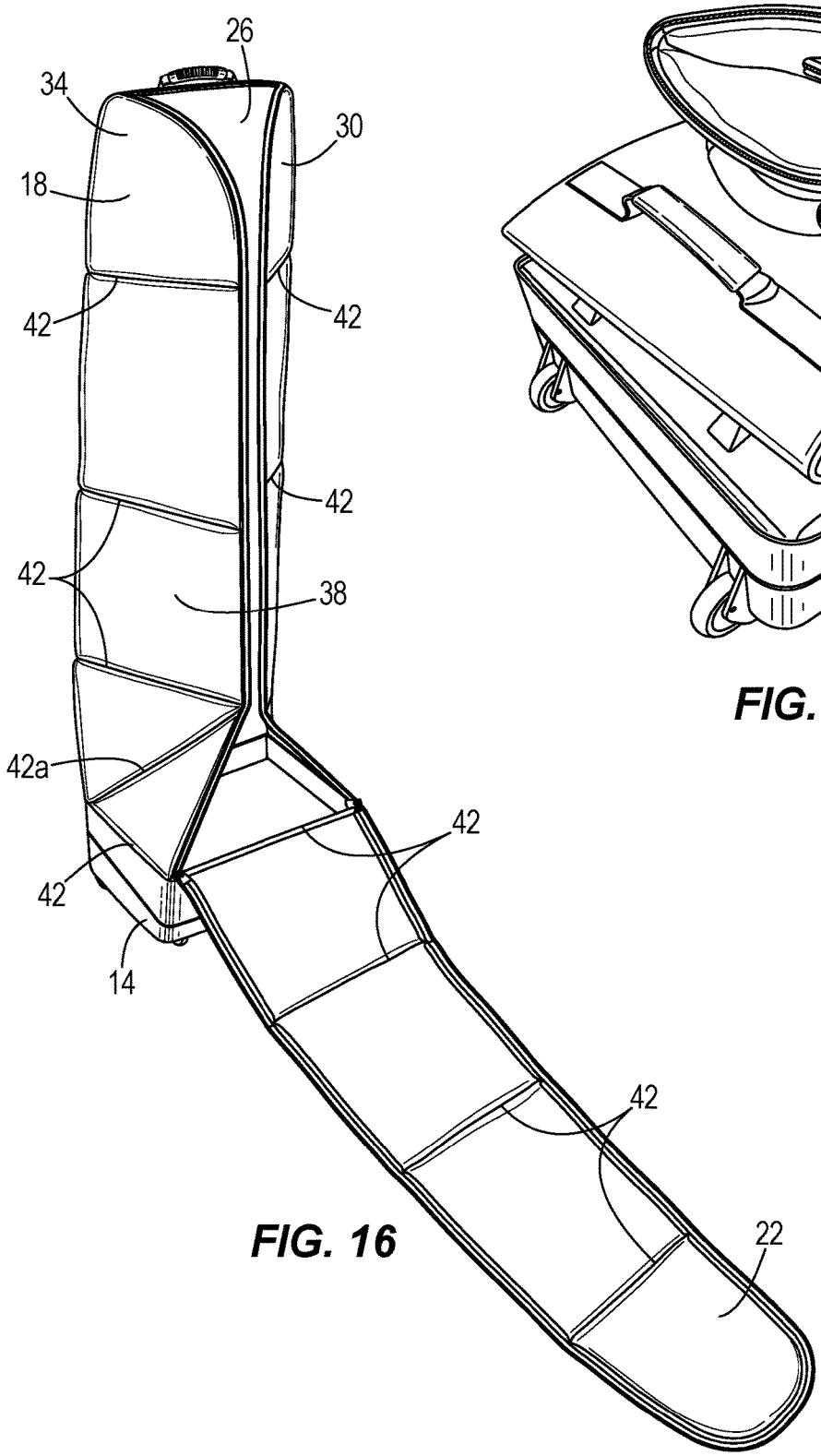
FIG. 16 is a perspective view of the rolling collapsible travel luggage bag of FIG. 1 in the upright position with the front flap disengaged from a first side portion, a second side portion, and a back portion.

The front, back, first side, and second side portions 22, 26, 30, 34 are each formed of a plurality of panels interconnected by an outer shell 38 (see FIG. 16). The outer shell 38 preferably is formed of a cloth or other fabric. For example, the fabric may be polyester, nylon, canvas, denim, or any other fabric material suitable for use in a luggage type application. In each of the portions 22, 26, 30, 34, the outer shell 38 includes stitching to seal the outer cover 38 and to define a plurality of pockets, each of which receives a respective panel. Between adjacent pockets in each portion 22, 26, 30, 34 are folds 42 (see FIGS. 1-9, and 16). To form the folds 42, stitching is provided at desired fold locations on the outer shell 38 of each portion 22, 26, 30, 34. In other embodiments, the folds 42 may be formed in any other suitable or desired manner to facilitate folding of each portion 22, 26, 30, 34. The folds 42 are not only provided between adjacent or consecutive panels in each portion 22, 26, 30, 34, but are generally provided between adjacent or consecutive panels between portions 26, 30, 34.

Referring to FIGS. 7A-7D, each portion 22, 26, 30, 34 is shown with the outer cover 38 removed and illustrating the plurality of panels 46. Each panel 46 preferably is formed of a polyethylene board material $[(C_2H_2)_nH_2]$, a foam material, a cloth material, or a combination thereof. The polyethylene board material may be any industry standard grade, including, but not limited to, ultra-high molecular weight polyethylene (UHMWPE), ultra-low molecular weight polyethylene (ULMWPE), high molecular weight polyethylene (HMWPE), high-density polyethylene (HDPE), high-density cross-linked polyethylene (HDXLPE), cross-linked polyethylene (PEX), medium-density polyethylene (MDPE), linear low-density polyethylene (LLDPE), low-density polyethylene (LDPE), very-low density polyethylene (VLDPE), and chlorinated polyethylene (CPE). In other embodiments, the panels 46 may be formed of polyurethane, acrylonitrile butadiene styrene, combinations thereof, or any other suitable material.

The panels 46 of each portion 22, 26, 30, 34 are arranged in panel zones, panel rings, or bands 50 that are horizontally stacked or arranged in a direction away from the base 14. The panel zones 50 generally extend around a circumference of the luggage bag 10. Depending on the zone 50 and location along portions 22, 26, 30, 34, any panel 46 may be formed of a different material (e.g. a foam material, a board material, or a combination of foam and board material), may have a different panel thickness, and/or a different panel stiffness or rigidity.

A first or bottom panel zone 50*a* is located along a base of each portion 22, 26, 30, 34 and preferably has a first panel height or length $H_1$. The illustrated first panel height $H_1$ is approximately 6.5 cm, but may be greater than or less than 6.5 cm based on the size, shape, or orientation of the luggage bag 10. The first panel zone 50*a* includes panels 46*a* formed of a stiff board material having a thickness of approximately 1.75 mm. The panels 46*a* of the first panel zone 50*a* are illustrated as rectangular in shape, however in other embodiments may be any suitable or desired shape or combination of shapes. For example, the panels of the first panel zone 50*a* may be sloped or have a narrowing height $H_1$ (see FIG. 3) to conform to the base 14. The panels 46*a* of the first panel zone 50*a* engage or otherwise connect to the base 14 (see FIG. 3).

Figure 8:
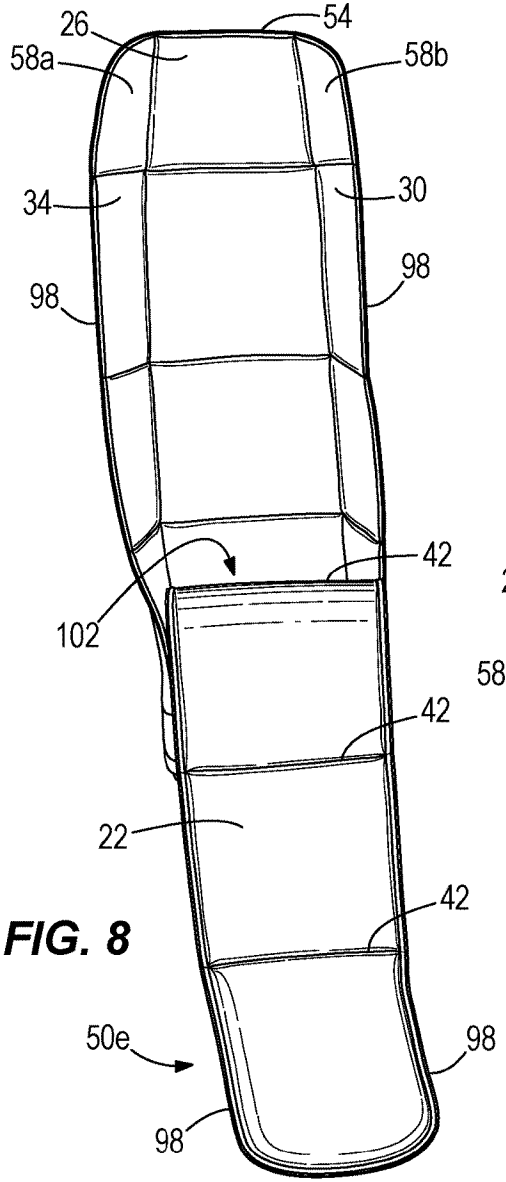
FIG. 8 is a perspective view of the rolling collapsible travel luggage bag of FIG. 1 in the upright position with the front flap partially disengaged to provide access to an interior chamber.

Positioned adjacent the first panel zone 50*a* in a direction away from base 14 is a second panel zone 50*b* along each portion 22, 26, 30, 34. The second panel zone 50*b* preferably has a second panel height or length $H_2$ illustrated as approximately 30 cm, but may be greater than or less than 30 cm based on the size, shape, or orientation of the luggage bag 10. The front portion 22 of the second panel zone 50*b* includes a panel 46*a*. The back, first side, and second side portions 26, 30, 34 of the second panel zone 50*b* include panels 46*b* formed of a relatively stiff board material combined with foam. The stiff board material preferably has a thickness of approximately 2.5 mm. The positioning of the panels 46*b* near or approximate the base 14 provides structural support for the back, first side, and second side portions 26, 30, 34 while the luggage bag 10 is in the upright position, as illustrated in FIG. 8. In a preferred embodiment, the panels of the second panel zone 50*b* in the front and back portions 22, 26 have a generally rectangular shape while the panels in the first side and second side portions 30, 34 have a generally square shape; however, this square shape is defined by two separate triangular panels having an angled fold 42*a* there between, which facilitates collapsibility of the cover 18 (discussed in more detail below). In other embodiments, the panels of the second panel zone 50*b* may be any suitable or desired shape or combination of shapes.

Adjacent the second panel zone 50*b* in a direction away from base 14 is a third panel zone 50*c* along each portion 22, 26, 30, 34. The third panel zone 50*c* preferably has a third panel height or length $H_3$ illustrated as approximately 32 cm, but may be greater than or less than 32 cm based on the size, shape, or orientation of the luggage bag 10. The front portion 22 and side portions 30, 34 of the third panel zone 50*c* each include a panel 46*c* formed of a relatively stiff board material combined with foam. The stiff board material preferably has a thickness of approximately 1.0 mm. The back portion 26 of the third panel zone 50*c* includes a panel 46*a* as previously described. In the illustrated embodiment, the panels of the third panel zone 50*c* in the front, back, first side, and second side portions 22, 26, 30, 34 have a generally trapezoidal shape. In other embodiments, the panels of the third panel zone 50*c* may be any suitable or desired shape or combination of shapes.

A fourth panel zone 50*d* is adjacent the third panel zone 50*c* in a direction away from base 14 along each portion 22, 26, 30, 34, and preferably has a fourth panel height of length $H_4$ illustrated as approximately 32 cm, but may be greater than or less than 32 cm based on the size, shape, or orientation of the luggage bag 10. The illustrated fourth panel zone 50*d* is substantially the same as the third panel zone 50*c* with regard to panel type, positioning, and shape.

At the top of each portion 22, 26, 30, 34 furthest from the base 14 is a fifth panel zone or top panel zone 50*e*. The back, first side, and second side portions 26, 30, 34 of the top panel zone 50*e* preferably have a fifth panel height or length $H_5$ illustrated as approximately 20 cm. The back portion 26 includes a panel in the top panel zone 50*e* generally trapezoidal in shape and having an end edge 54. The first and second side portions 30, 34 each include a panel in the top panel zone 50*e* that has a respective arcuate edge 58*a*, 58*b*. The arcuate edges 58*a*, 58*b* lead to the end edge 54 of the back portion 26 (see FIGS. 8-9).

Figure 2:
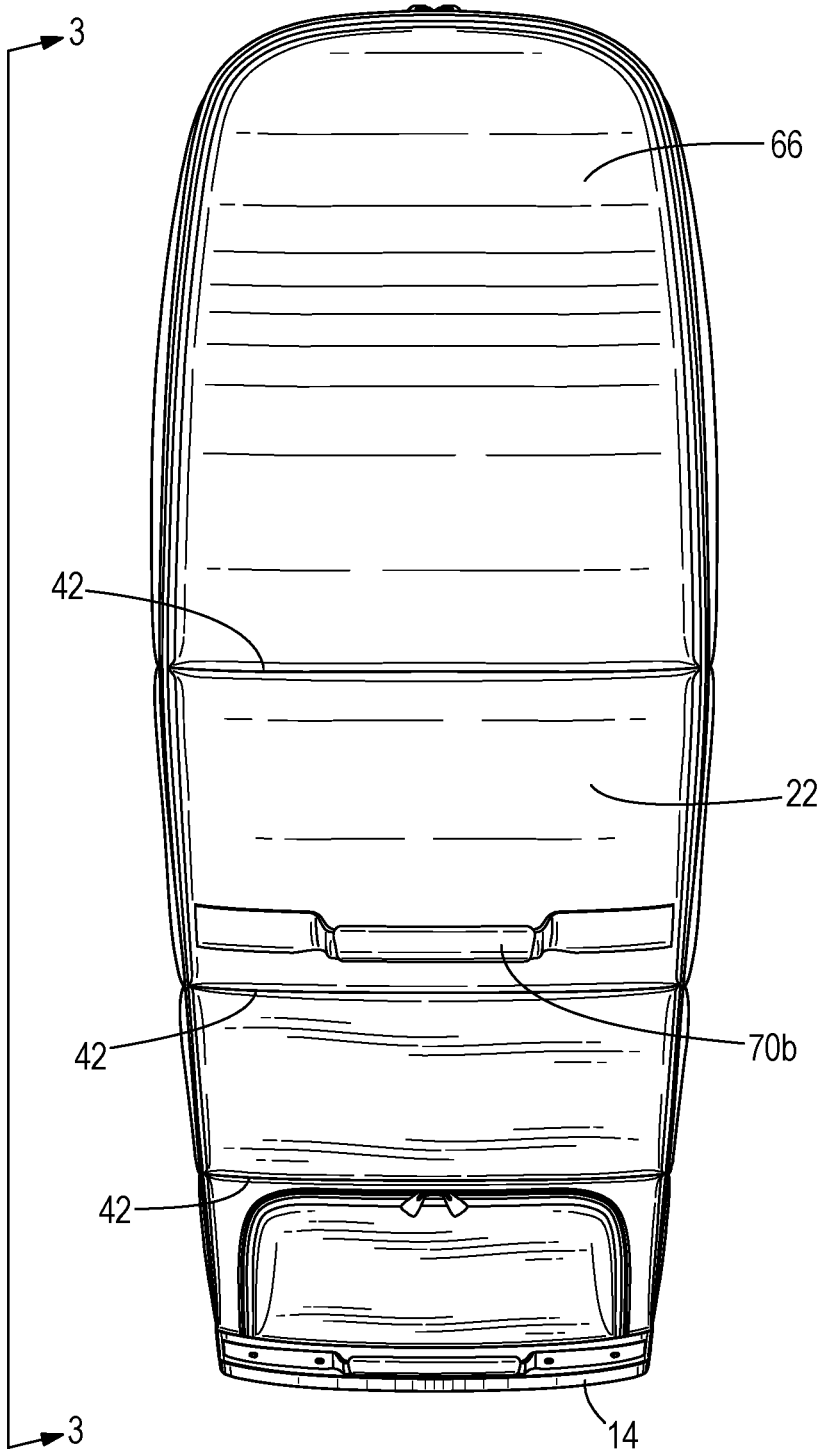
FIG. 2 is a perspective view from the top of the rolling collapsible travel luggage bag of FIG. 1 taken along line 2-2 of FIG. 1.

The front portion 22 of the top panel zone 50*e* preferably has a sixth panel height or length $H_6$ illustrated as approximately 38.5 cm. While the fifth panel height $H_5$ may be greater than or less than 20 cm and the sixth panel height $H_6$ may be greater than or less than 38.5 cm based on the size, shape, or orientation of the luggage bag 10, the sixth panel height $H_6$ is generally greater than the fifth panel height $H_5$. The panel within zone 50*e* of the front portion 22 includes a parabolic edge 62 that removably connects to the arcuate edges 58*a*, 58*b* and to the end edge 54, and the additional panel height $H_6$ of the front portion 22 defines or forms an arcuate or curved face 66 (see FIGS. 2-3) that extends over or overlaps a portion of a base footprint defined by a periphery of the base 14, as best illustrated in FIG. 2. The arcuate face 66 removably connects to the back, first side, and second side portions 26, 30, 34.

The back portion 26 includes in the top panel zone 50*e* a panel 46*c* formed of a relatively stiff board material combined with foam. The stiff board material has a thickness of approximately 1.0 mm. The front, first side, and second side portions 22, 30, 34 include in the top panel zone 50*e* a panel 46*d* formed of foam and that does not include a board material. The foam panels 46*d* provide flexibility to the front, first side, and second side portions 22, 30, 34 to facilitate formation of the arcuate face 66 (see FIGS. 2-3) of the front portion 22 in the top panel zone 50*e*.

It should be appreciated that a greater thickness of the board material leads to a more rigid or a greater stiffness panel. For example, the panels in the second panel zone 50*b* are more rigid and/or have a greater stiffness than the panels in the top panel zone 50*e*. Generally, the overall stiffness or rigidity of the panels decreases from the base 14 upward toward the arcuate face 66.

In the illustrated embodiment, twenty-two total panels 46 define the cover 18. In other embodiments, fewer than twenty-two total panels or more than twenty-two total panels may be used to define the cover 18. The total number of panels may be based on the size, shape, and/or collapsibility of the luggage bag 10.

The illustrated embodiment of the luggage bag 10 has a height or length, defined by the sum of heights $H_1$ to $H_5$, of approximately 120.5 cm (or approximately 47.5 inches). In other embodiments, the luggage bag 10 may have a height or length in a range of approximately 110 cm to approximately 140 or more cm. Stated another way, the luggage bag 10 may have a height or length suitable to receive a golf bag and/or one or more full length golf clubs.

Figure 3:
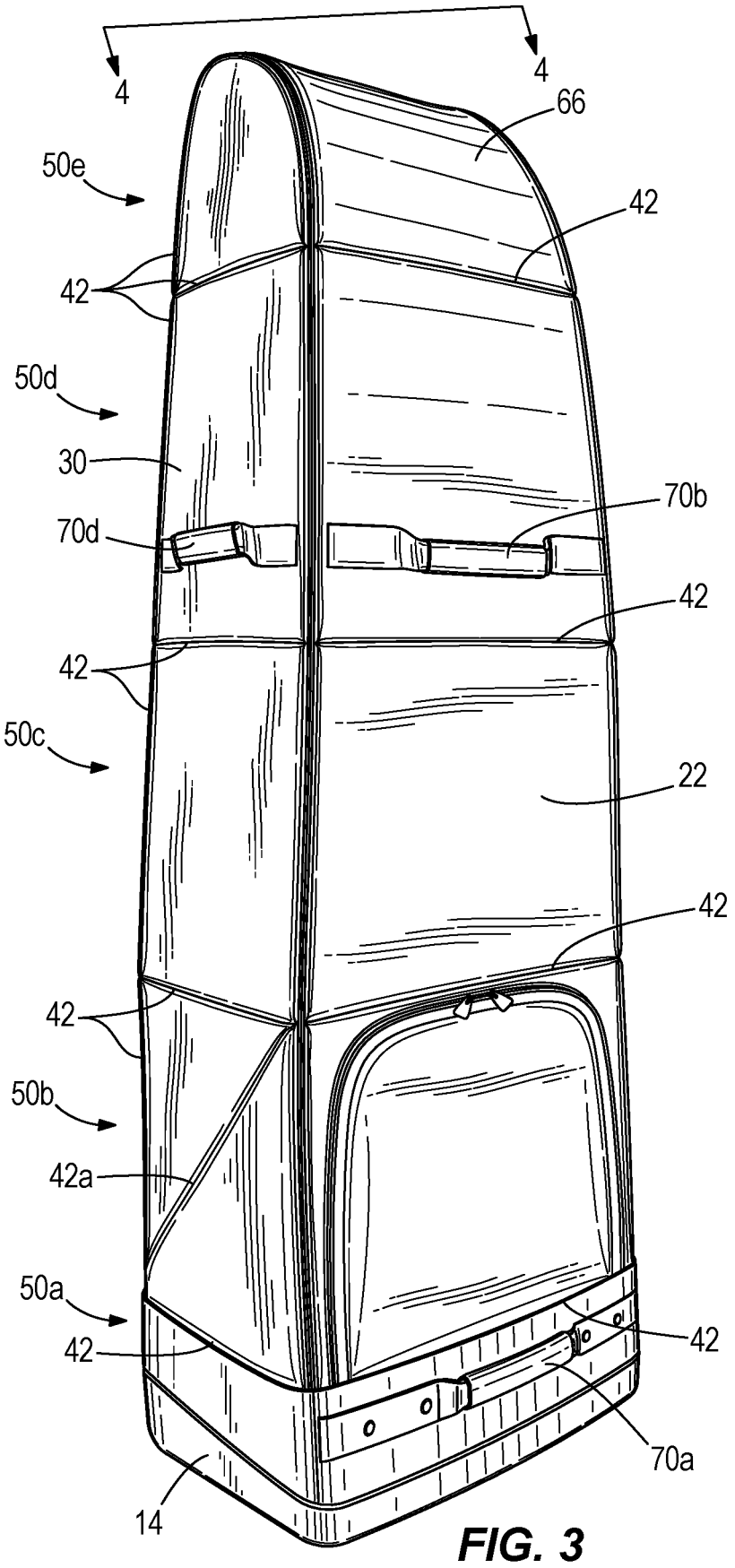
FIG. 3 is a perspective view from a first side of the rolling collapsible travel luggage bag of FIG. 1 taken along line 3-3 of FIG. 2.

Referring back to FIGS. 1-6, the luggage bag 10 includes a plurality of handles 70 to assist with lifting and otherwise carrying the luggage bag 10. As illustrated in FIGS. 1 and 3, a first handle 70*a* is connected to the front portion 22 in the first panel zone 50*a* proximate or near the base 14 to provide a user a location to grasp near the base 14. Referring to FIGS. 1-6, a plurality of second handles 70*b*, 70*c*, 70*d*, 70*e* are respectively connected to the front portion 22, back portion 26, first side portion 30, and second side portion 34. The second handles 70*b*, 70*c*, 70*d*, 70*e* are illustrated in the same horizontal plane around the luggage bag 10, approximately 70 cm to 90 cm from the base 14 (or surface on which the base 14 is positioned). In other embodiments, the second handles 70*b*, 70*c*, 70*d*, 70*e* may be offset, staggered, or positioned on panels in other panel zones 50, and at various distances from the base 14 (or surface on which the base 14 is positioned). In addition, fewer or more than four second handles 70*b*, 70*c*, 70*d*, 70*e* may be connected to luggage bag 10. The first handle 70*a* and second handles 70*b*, 70*c*, 70*d*, 70*e* may be any suitable handle for use with luggage. In the illustrated embodiments, the handles 70*a*, 70*b*, 70*c*, 70*d*, 70*e* are formed of a durable fabric, and include a handle wrap. In other embodiments, the handles 70*a*, 70*b*, 70*c*, 70*d*, 70*e* may be formed of any suitable materials.

Figure 4A:
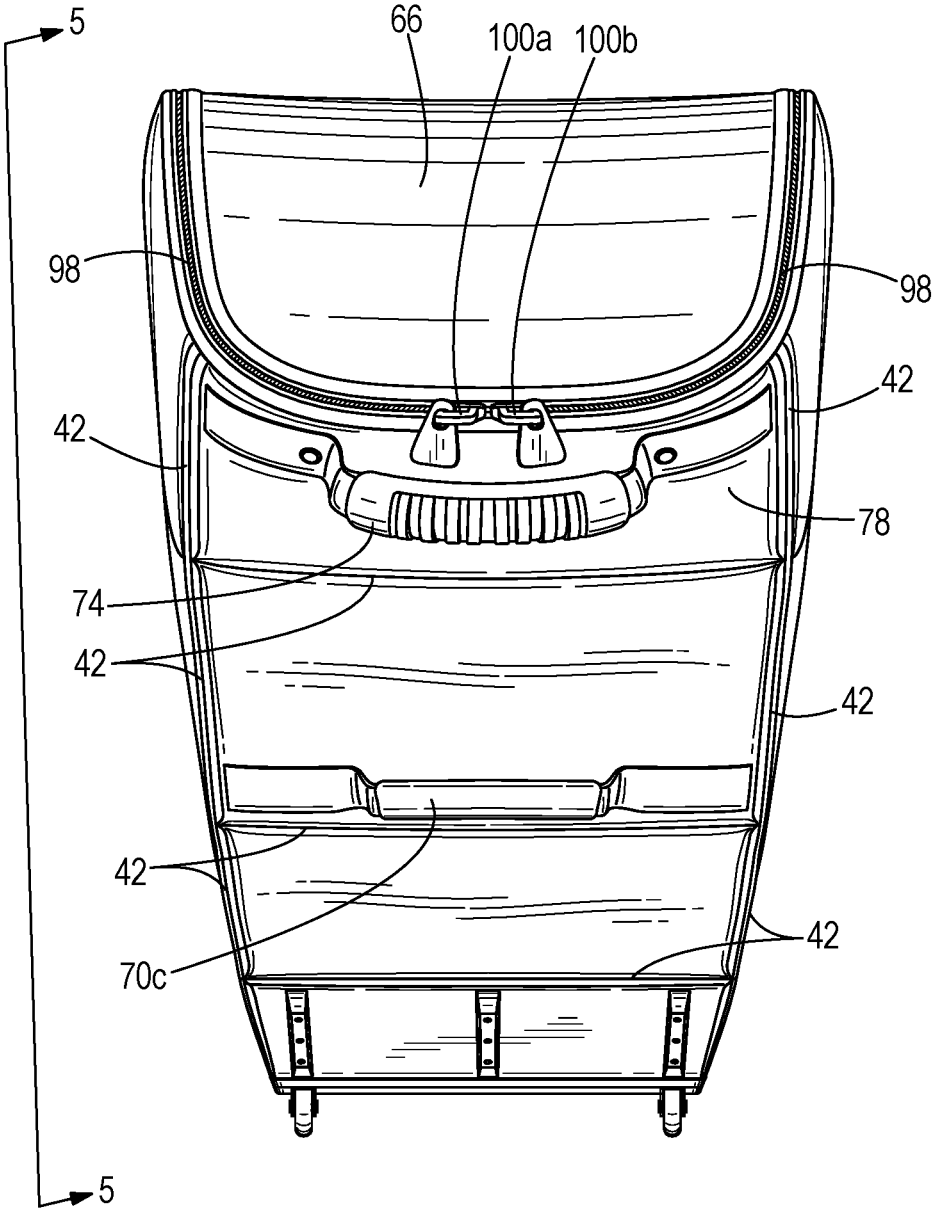
FIG. 4A is a perspective view from the rear of the rolling collapsible travel luggage bag of FIG. 1 taken along line 4-4 of FIG. 3, illustrating a first position of a rolling handle.
Figure 4B:
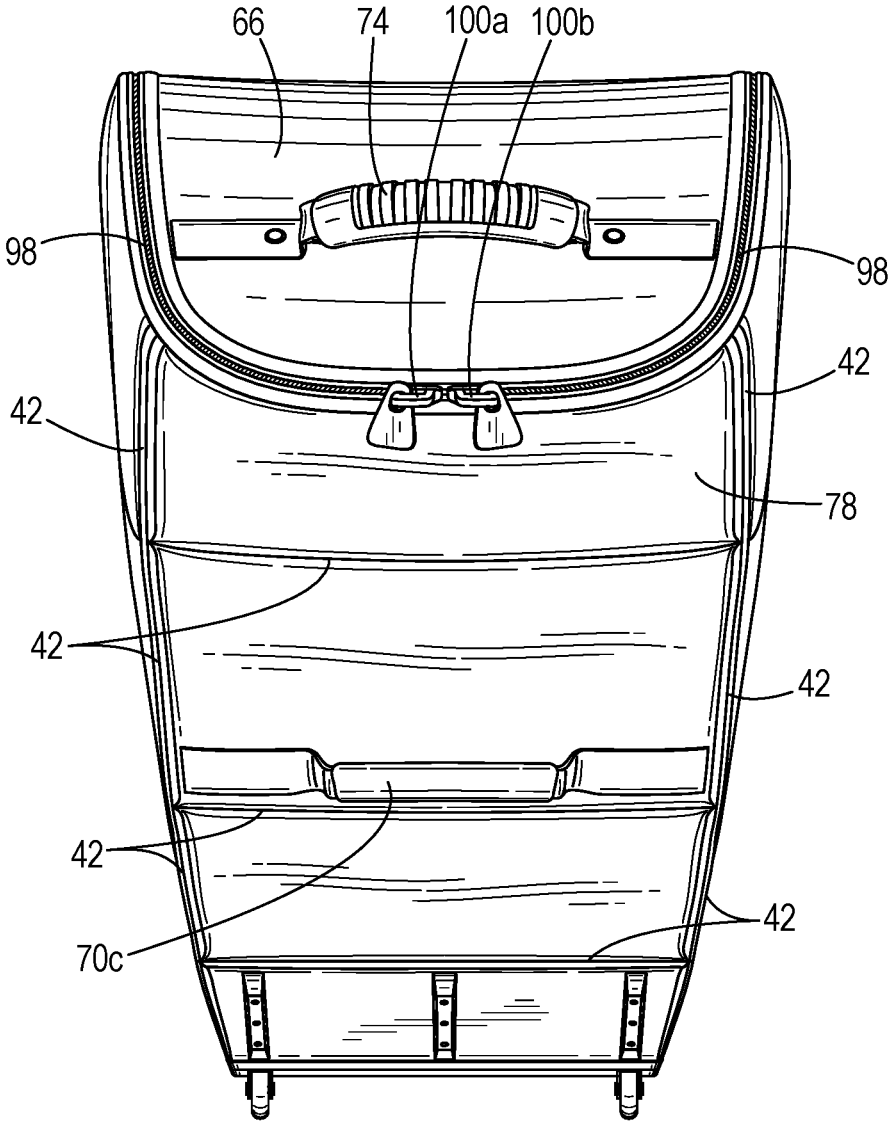
FIG. 4B is a perspective view from the rear of the rolling collapsible travel luggage bag of FIG. 1 taken along line 4-4 of FIG. 3, illustrating a second position of the rolling handle.
Figure 5:
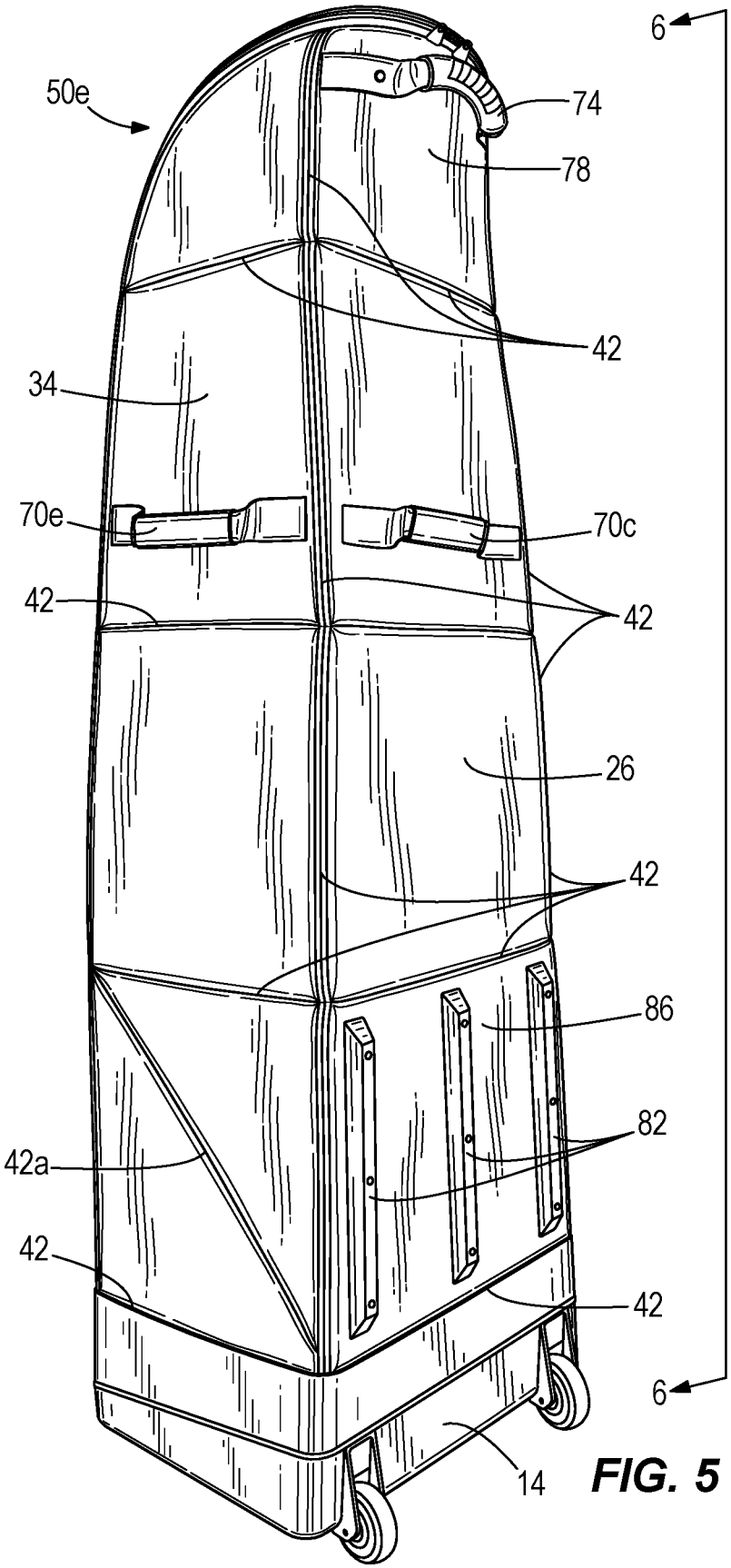
FIG. 5 is a perspective view from a second side of the rolling collapsible travel luggage bag of FIG. 1 taken along line 5-5 of FIG. 4A.
Figure 6:
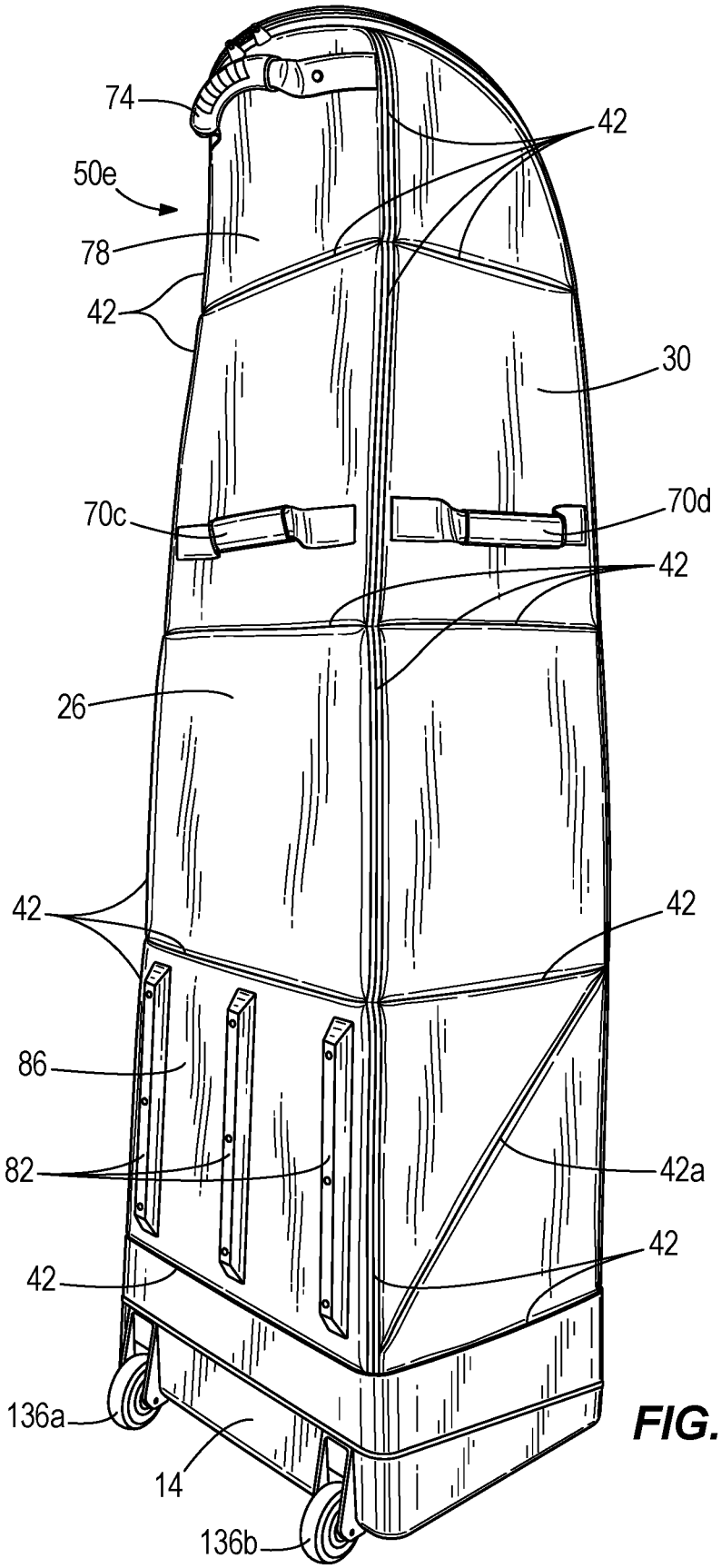
FIG. 6 is a perspective view from the rear of the rolling collapsible travel luggage bag of FIG. 1 taken along line 6-6 of FIG. 5.

Referring to FIGS. 4A, 5, and 6, the luggage bag 10 includes a rolling handle 74 provided on a panel or top back panel 78 on the back side 26 within the top panel zone 50*e*. In the illustrated embodiment, the rolling handle 74 projects away from the back side 26, and is located adjacent or towards the end edge 54 (see FIG. 8) of the panel 78. In other embodiments, the handle 74 may be located at any desired location along the panel 78. The rolling handle 74 is shown as reinforced with a rubber handle wrap but can be any other suitable handle for use with luggage bag 10. In yet other embodiments, and as illustrated in FIG. 4B, the rolling handle 74 may instead be positioned on the arcuate face 66. Alternatively, the luggage bag 10 may include two rolling handles 74, with one positioned on the panel 78 (for example the position illustrated in FIG. 4A) and the other on the arcuate face 66 (for example the position illustrated in FIG. 4B).

Referring now to FIGS. 5 and 6, the luggage bag 10 includes a bumper in the form of rails 82 positioned on a panel or bottom back panel 86 within the second panel zone 50*b*, adjacent but separate from the base 14. The rails 82 extend upward, away from the base 14 and provide protection against luggage damage when the luggage bag 10 is pulled over a curb or other uneven surface. In the illustrated embodiment, the rails 82 are arranged on the single panel 86 and do not extend to any adjacent panel or to the base 14, thereby facilitating collapsibility of the luggage bag 10 (further detailed below). In one or more examples of embodiments, the rails 82 are approximately 20 cm to 30 cm long with a width of approximately 2 cm to 5 cm. In other embodiments the rails 82 may be any length or width suitable for providing protection against damage to the luggage bag 10 while facilitating collapsibility of the luggage bag 10. In the illustrated embodiment, the bag 10 includes three total rails 82, with outermost first and second rails 82 in respective vertical alignment with wheels 136*a*, 136*b*. A third middle rail 82 is approximately equidistant from the outermost rails 82. In other embodiments, any suitable number of rails 82 may be implemented, for example two rails 82 or four or more rails 82. In yet other embodiments, additional bumpers or rails 82 may be positioned on other panels, including in the first or bottom panel zone 50*a* or on the base 14.

FIGS. 6A-6D illustrate an alternative embodiment of the luggage bag 10 having a bumper or bumper assembly 180 that extends from the base 14 along a portion of the cover 18. The bumper 180 includes rails or rail members 182 that removably engage a corresponding rail extension 186 projecting from the base 14. The combination rails 182 and rail extensions 186 provide protection against luggage damage when the luggage bag 10 is pulled over a curb or other uneven surface by providing a bumper that continuously or directionally extends from the base 14 along a portion of the cover 18, while also facilitating collapsibility of the luggage bag 10 through disengagement of the rails 182 from the rail extensions 186. While the illustrated embodiment depicts the plurality of rails 182 and the plurality of corresponding rail extensions 186 as three total rails 182 and three total rail extensions 186, in other embodiments, the plurality of rails 182 may include any number of rails 182 (e.g., two to six or more) and the plurality of rail extensions 186 may include any corresponding number of rail extensions 186 (e.g., two to six or more).

Figure 6A:
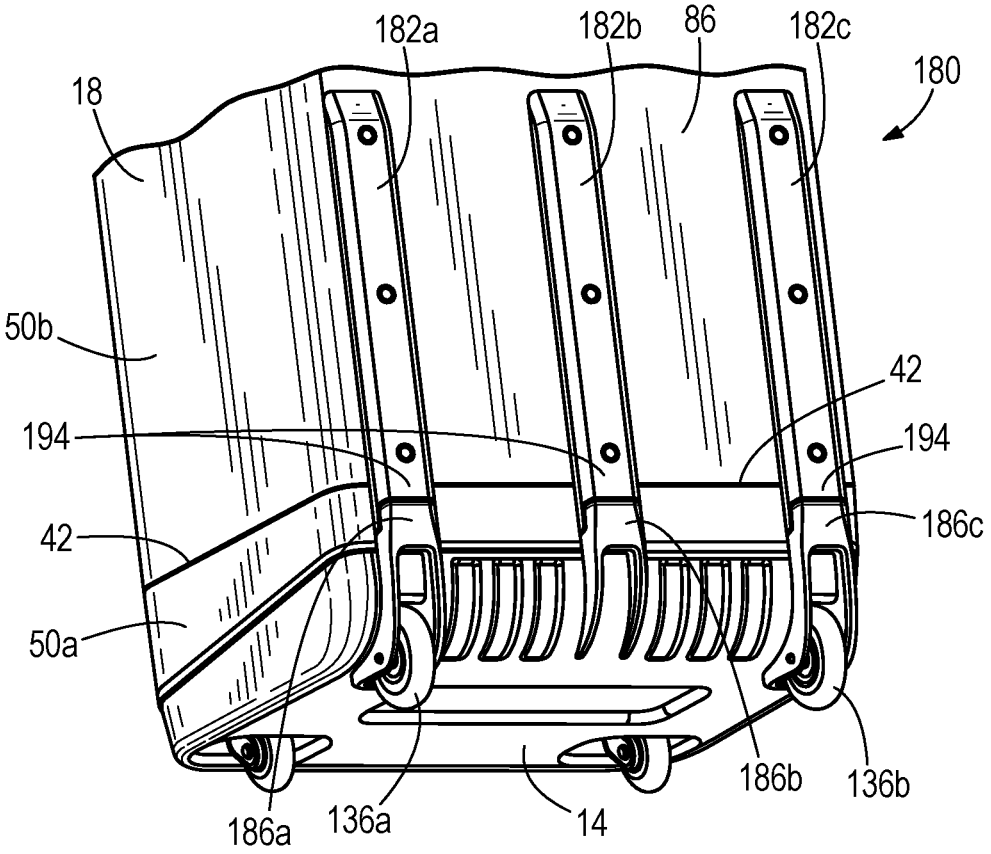
FIG. 6A is a perspective view of an alternative embodiment of the rails for use with the rolling collapsible travel luggage bag illustrated in FIGS. 5 and 6 and shown in an upright position.
Figure 6B:
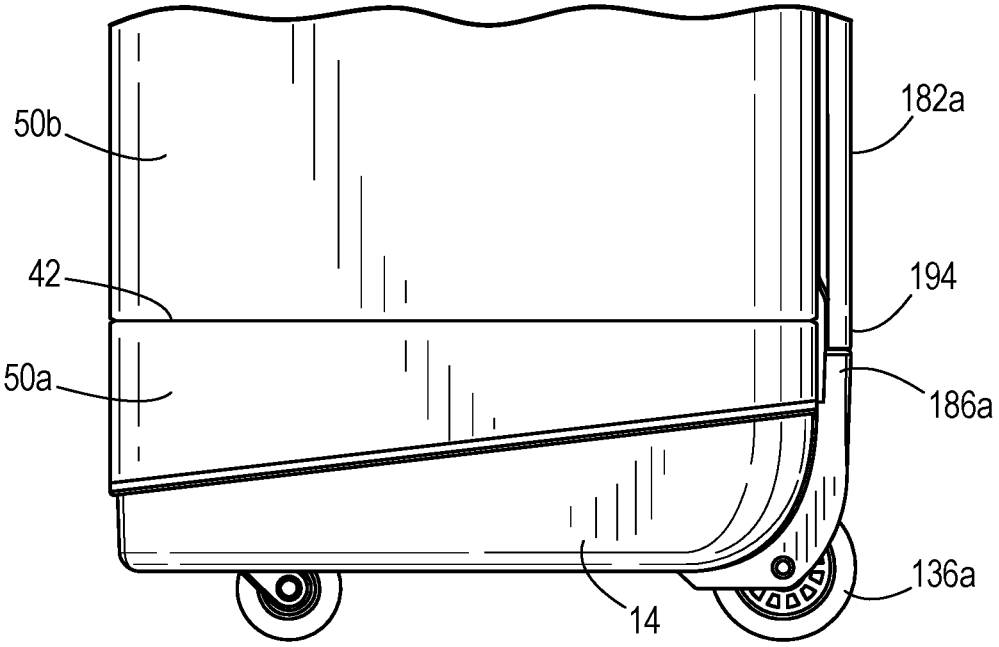
FIG. 6B is a side view of the rolling collapsible travel luggage bag of FIG. 6A.

Referring to FIGS. 6A-6B, the rails 182 are illustrated as a plurality of rails 182*a, b, c* positioned on a panel or bottom back panel 86 within the second panel zone 50*b*. Each rail 182*a, b, c* is coupled to the panel 86 by one or more attachment members, illustrated as a plurality of rivets through each rail 182*a, b, c*. In other embodiments, the rails 182*a, b, c* can be attached to the panel 86 by any suitable attachment member. Each rail 182*a, b, c* defines a channel 190 (best shown in FIG. 6C). The channel 190 may further be defined by an elongated portion 194 of the rail 182*a, b, c* (shown in FIGS. 6B and 6D), which is integrally formed with the rail 182*a, b, c*. The rails 182*a, b, c* extend from the panel 86 in the second panel zone 50*b* towards the base 14, crossing the fold 42 between the first and second panel zones 50*a, b* into the first panel zone 50*a*. More specifically, the elongated portion 194 of each rail 182*a, b, c* crosses the fold 42 between the first and second panel zones 50*a, b* and into the first panel zone 50*a*. Each rail 182 is approximately 1.9 inches wide, but in other embodiments may be anywhere from 1.5 inches to 3.0 inches or more wide.

Referring to FIGS. 6A-6D, the rail extensions 186 are illustrated as a plurality of rail extensions 186*a, b, c* that are positioned on and project away from the base 14. In the embodiment shown, the rail extensions 186*a, b, c* are each generally in alignment with and project towards the corresponding rails 182*a, b, c*. The outermost rail extensions 186*a, c* are further generally aligned with respective wheels 136*a, b* of the base 14, while the intermediate rail extension 186*b* is between, and may be centered between, the outermost rail extensions 186*a, c*.

Figure 6C:
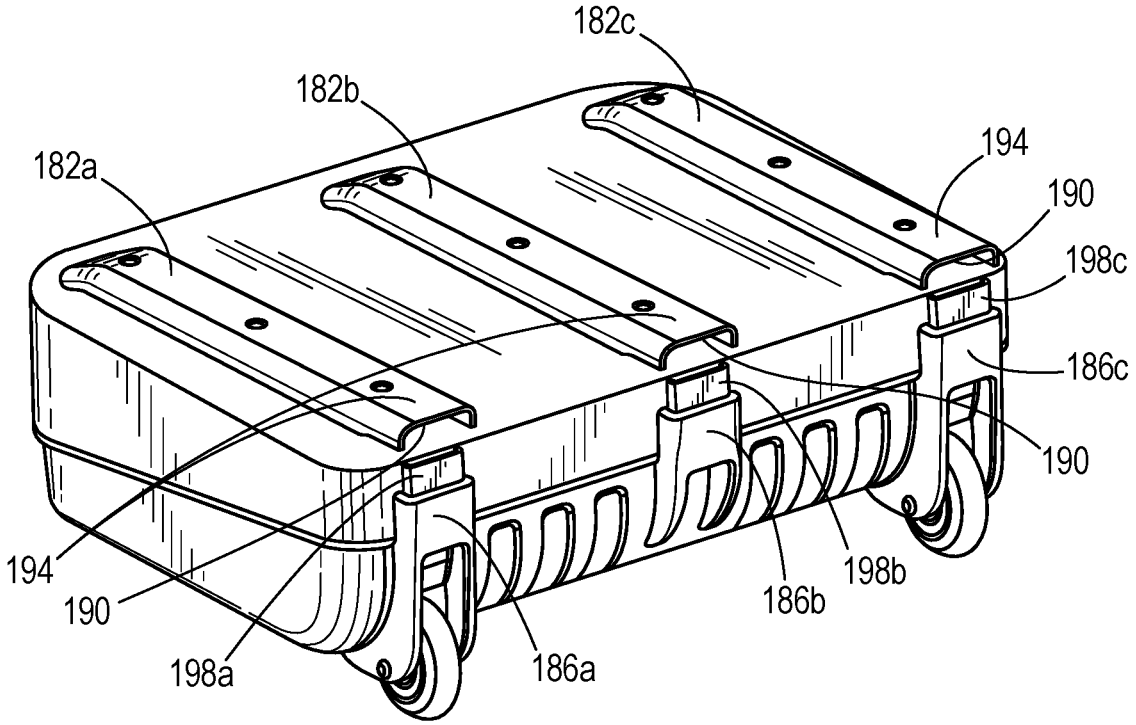
FIG. 6C is a perspective view of the rolling collapsible travel luggage bag of FIG. 6A shown in a collapsed, folded position.
Figure 6D:
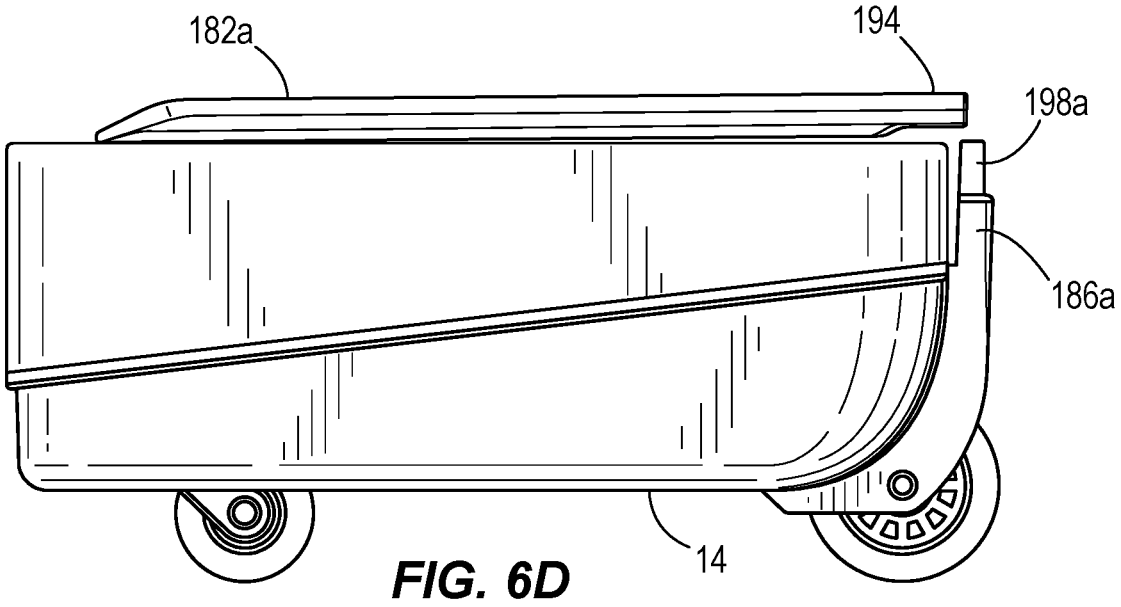
FIG. 6D is a side view of the rolling collapsible travel luggage bag of FIG. 6C.
Figures 7A, 7B, 7C, 7D:
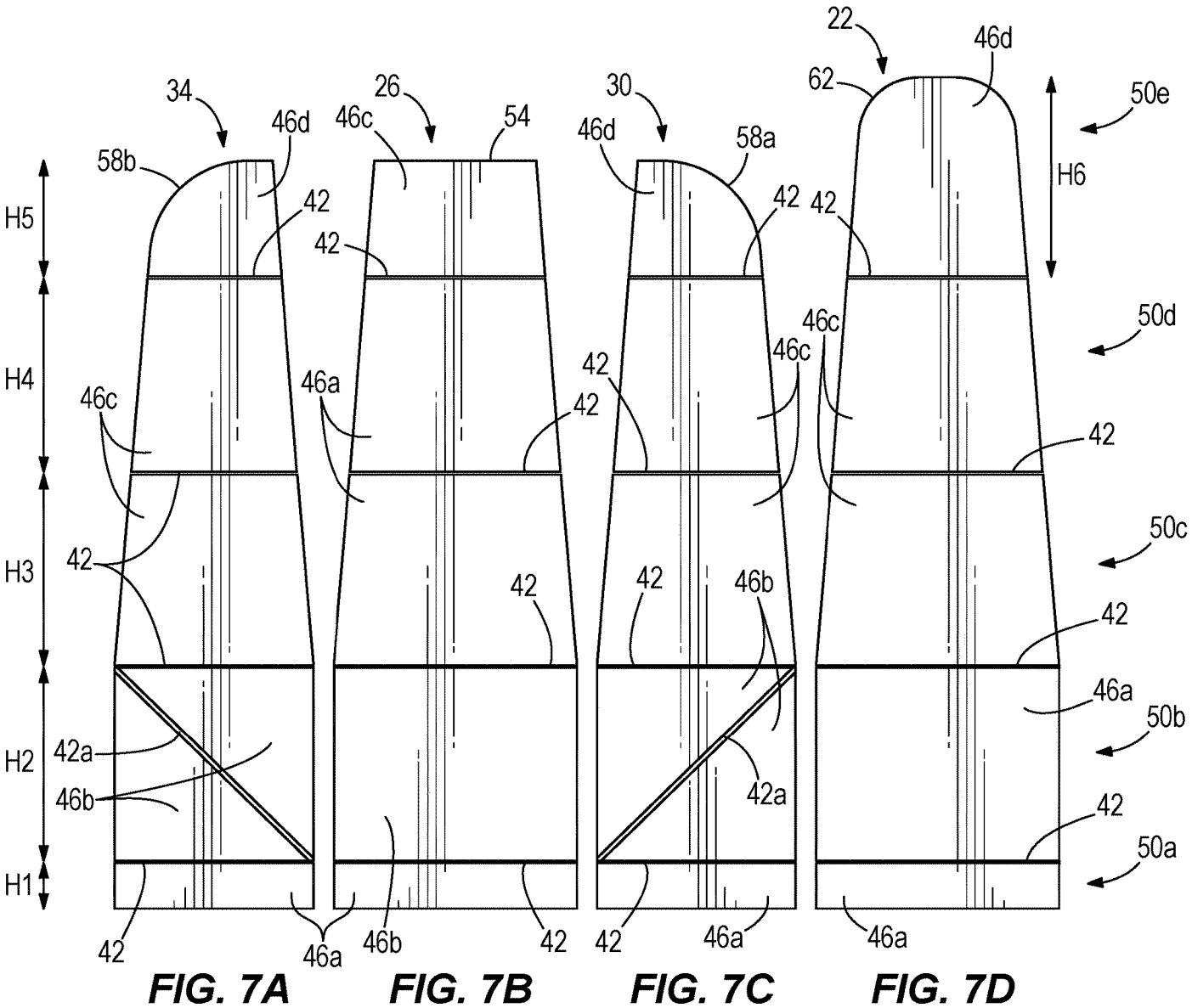
FIG. 7A is an elevation view of the second side portion of the rolling collapsible travel luggage bag of FIG. 1, with the outer shell removed to illustrate the respective panels.
FIG. 7B is an elevation view of the back portion of the rolling collapsible travel luggage bag of FIG. 1, with the outer shell removed to illustrate the respective panels.
FIG. 7C is an elevation view of the first side portion of the rolling collapsible travel luggage bag of FIG. 1, with the outer shell removed to illustrate the respective panels.
FIG. 7D is an elevation view of the front flap of the rolling collapsible travel luggage bag of FIG. 1, with the outer shell removed to illustrate the respective panels.

Each rail extension 186*a, b, c* includes a projection or protrusion 198*a, b, c* (shown in FIGS. 6C-6D). Each projection 198 is approximately 1.5 inches wide, but in other embodiments may be anywhere from 1.2 inches to 2.0 inches or more wide, and more specifically may be any width that is complementary to an associated rail 182 in order to facilitate engagement between the rail 182 and the projection 198. Each rail extension 186 extends approximately 1.8 inches from the base 14, with the projection 198 being approximately 0.6 inches (or 33% of the rail extension 186 length). In other embodiments, the length of the rail extension 186 may be any suitable length, and the corresponding length of the projection 198 may be any suitable length or percentage of the rail extension 186 length.

Each of the rail members 182*a, b, c* removably engages a corresponding rail extension 186*a, b, c*. More specifically, each projection 198*a, b, c* is removably received by the elongated portion 194 of the channel 190 of a corresponding rail member 182*a, b, c* to form the bumper 180, which continuously extends from the base 14 along a portion of the cover 18 when the luggage bag 10 is in the upright position illustrated in FIGS. 6A-6B (or a closed configuration, as shown in FIG. 1). While the illustrated embodiment discloses the removable engagement in the form of the rail members 182*a, b, c* receiving a portion of a corresponding rail extension 186*a, b, c*, in other embodiments any suitable removable engagement between the rail members 182 and rail extensions 186 can be used. For example, the rail extensions 186 may alternatively define a respective channel having a size suitable to receive a portion of a corresponding rail member 182. As another example, each rail member 182 may removably couple to a corresponding rail extension 186 by a connection member (e.g., a snap button, an interference fit, or other suitable fastener). In yet another embodiment, a combination of removable engagement as illustrated in FIGS. 6A-6D together with the use of one or more connection members may be employed.

To facilitate collapsibility of the luggage bag 10, each of the rails 182*a, b, c* disengages a corresponding rail extension 186*a, b, c* when the luggage bag 10 is in a collapsed, folded position (or a collapsed configuration) as illustrated in FIGS. 6C-6D. To disengage each rail 182*a, b, c* from the corresponding rail extension 186*a, b, c*, the user collapses the panel 86 having the attached rails 182*a, b, c* along the fold 42. The rails 182*a, b, c* disengage from the associated rail extensions 186*a, b, c*, as the rails 182*a, b, c* separate from the associated projections 198*a, b, c* during collapse of the cover 18. In other embodiments, the rails 182*a, b, c* may disengage from the associated rail extensions 186*a, b, c* by sliding, pivoting, lifting away, or otherwise through any suitable manner of separating the rails 182*a, b, c* from the rail extensions 186*a, b, c*.

Referring back to FIG. 1, the luggage bag 10 includes a storage pocket 90 on the front portion 22, more specifically on a panel or bottom front panel 94 within the second panel zone 50*b*, adjacent but separate from the base 14. The storage pocket 90 includes a zipper, zip fastener, or any other suitable fastener to permit access to the inside of the storage pocket 90. In other embodiments, the storage pocket 90 can be located on another panel on the front, back, first side, or second side portions 22, 26, 30, 34. In addition, more than one storage pocket 90 may be located on the luggage bag 10. To facilitate collapsibility of the luggage bag 10, the storage pocket 90 is preferably arranged on a single panel, and does not extend to any adjacent panel or to the base 14.

Referring now to FIG. 8, the back portion 26 preferably is integrally formed with the first side portion 30 and second side portion 34, for example, the back, first side, and second side portions 26, 30, 34 are stitched together or otherwise connected or formed as a unitary portion of cover 18. A connection member 98 (see also FIGS. 4A-B) in the form of a zip fastener or zipper separates the front portion 22 from the first and second side portions 30, 34 and the back portion 26. A first portion of the connection member 98 defines a portion of a perimeter of the front portion 22, while a second portion of the connection member 98 defines a portion of a perimeter of the first and second side portions 30, 34, extends along the arcuate edges 58*a*, 58*b*, and to the end edge 54 of the back portion 26. The connection member 98 thus removably connects the front portion 22 to the back, first side, and second side portions 26, 30, 34. It should be appreciated that the connection member 98 may be any suitable device or assembly for connecting the front portion 22 to the back, first side, and second side portions 26, 30, 34, including, but not limited to, a hook and loop fastener, a zip fastener, or a fly fastener. In addition, while the connection member 98 is illustrated in FIGS. 44A-B with two, opposing sliders 100*a*, 100*b* (such as in a two-way or a double-separating zip fastener), in other embodiments the connection member 98 may include one slider, or three or more sliders.

When the front portion 22 is connected to or engaged with the back, first side, and second side portions 26, 30, 34 (as shown in FIG. 1), the portions 22, 26, 30, 34 define an interior chamber 102 for receiving items for transport. The front portion 22 may be selectively or partially disconnected or disengaged from the back, first side, and second side portions 26, 30, 34 so that a user has various degrees of access to the interior chamber 102. In FIG. 8, the luggage bag 10 is shown in the upright position with only a part of the front portion 22 connected or engaged with the first side and second side portions 30, 34 by one or more connection members 98 (hereinafter referred to as connection member 98), thereby partially exposing the interior chamber 102. By partially exposing the interior chamber 102, a user may place and position items into the interior chamber 102 while the luggage bag 10 remains in the upright position (or is otherwise free standing).

As illustrated in FIG. 8, the luggage bag 10 is provided in the partial access or first standing access position. The front portion 22 is illustrated as bent over the fold 42 provided between panels in the second and third panel zones 50*b*, 50*c*. It should be appreciated that the front portion 22 may be selectively or partially disconnected from the back, first side, and second side portions 26, 30, 34 as to allow any desired number of panel zones 50 to bend or fold over a desired fold 42 in the front portion 22 and thereby provide varying amounts of access to the interior chamber 102.

Figure 9:
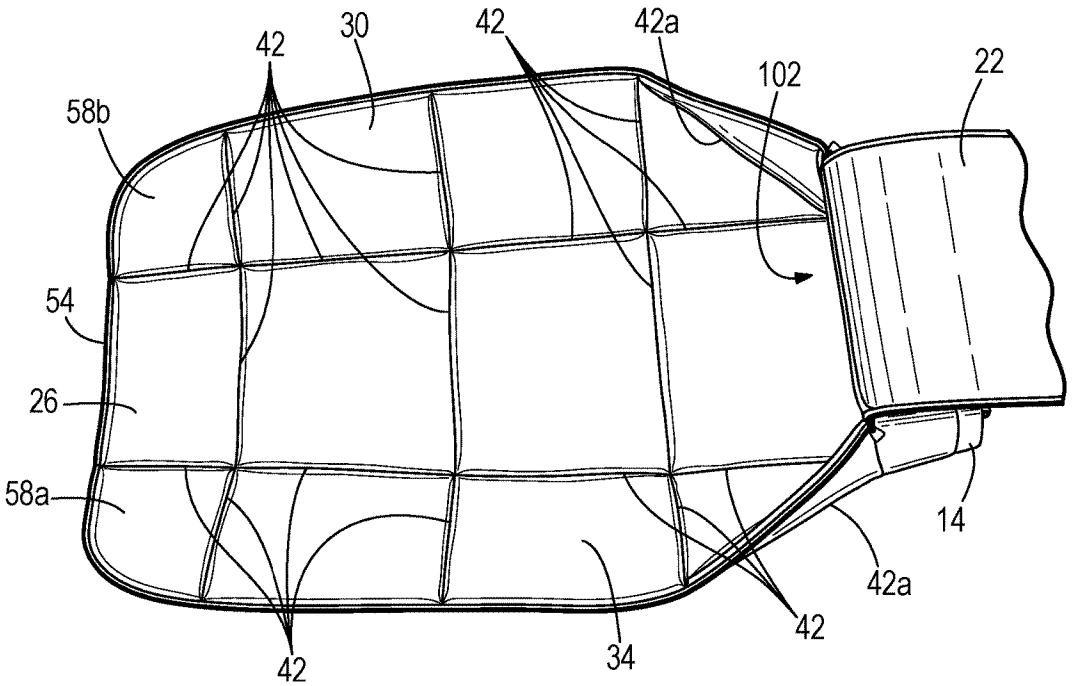
FIG. 9 is a partial view of the rolling collapsible travel luggage bag of FIG. 1 illustrating a butterfly opening providing access to the interior chamber without obstruction from a portion of a cover, and with a portion of the front flap shown.

Referring now to FIG. 9, components of the luggage bag 10 also fold or bend to form a butterfly opening, or second opening access position, in order to provide greater access to the interior chamber 102. With the luggage bag 10 placed with the back portion 26 positioned on a floor or other supporting surface, the connection member 98 may be opened so that the front portion 22 is no longer connected with the back, first side, and second side portions 26, 30, 34, but remains connected to the base 14 to expose the interior chamber 102. The first and second side portions 30, 34 are then free to pivot or fold away from each other along the respective folds 42 (or seams) between the side portions 30, 34 and the back portion 26. As the first and second side portions 30, 34 fold away from each other, the portions 30, 34 are each at an oblique angle to the back portion 26. The panels of the side portions 30, 34 in the second panel zone 50*b* also fold about the angled folds 42*a*. Once one or more items are placed into the interior chamber 102, the side portions 30, 34 are pivoted or folded towards each other, and the connection member 98 is reconnected (or closed), securing the front portion 22 to the back, first side, and second side portions 26, 30, 34 and closing the interior chamber 102. This butterfly opening allows for unobstructed insertion of large or bulky items into the interior chamber 102, as not only do the side portions 30, 34 pivot or fold away from each other, with the arcuate face 66 removed there is no lip or other edge structure that would obstruct or otherwise hinder insertion of items into the interior chamber 102. In other words, when the travel luggage bag is closed or opened in the manner shown in FIG. 8, the arcuate face 66 overlaps a portion of the base 14 to enclose the interior chamber 102. By opening the arcuate face 66 away from the side portions 30, 34 and back portion 26, and then pivoting or folding the side portions 30, 34 away from each other along folds 42, the back, first side, and second side portions 26, 30, 34 thereby define a butterfly opening that provides ready access to the interior chamber 102 unobstructed by a portion of the cover 18. In other embodiments, the front portion 22 may be detachable or otherwise removable from the base 14

Figure 14:
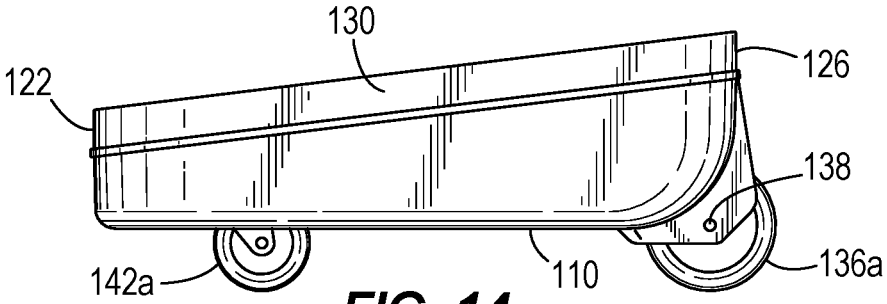
FIG. 14 is a first side view of the base taken along line 14-14 of FIG. 10.
Figure 15:
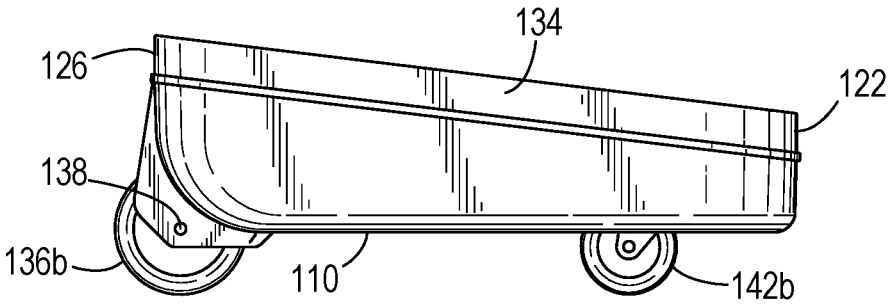
FIG. 15 is a second side view of the base taken along line 15-15 of FIG. 10.

With reference to FIGS. 10-15, the base 14 is illustrated in greater detail. The base 14 includes a bottom external surface 110 opposite an inside surface 114. The inside surface 114 is defined or surrounded by a front wall 122 opposite a back wall 126, and a first side wall 130 opposite a second side wall 134. The front wall 122 is located on the same side of the luggage bag 10 as the front portion 22, while the back wall 126 is provided on the same side of the luggage bag 10 as the back portion 26. As illustrated in FIGS. 14 and 15, the first and second side walls 130, 134 increase in height from the front wall 122 to the back wall 126, with the height being the distance of the wall away from the bottom surface 110. In other embodiments, the first and second side walls 130, 134 may have a uniform height from the front wall 122 to the back wall 126. The inside surface 114 preferably defines a planar or substantially flat receiving surface substantially free of protrusions or other structural obstructions that may interfere with receipt of items into the inside surface 114 of the base 14.

The base 14 includes a pair of wheels or skate wheels 136*a*, 136*b* provided on the back wall 126 side. The skate wheels 136*a*, 136*b* do not swivel about the base 14, and extend beyond a plane defined by the back wall 126 such that a portion of each of the wheels 136*a*, 136*b* extends outside of the base footprint defined by the bottom surface 110 and walls 122, 126, 130, 134. The wheels 136*a*, 136*b* include a common axis of rotation 138 preferably offset from the bottom surface 110 and a plane defined by the back wall 126 and are configured to act as a fulcrum about which the luggage bag 10 pivots from the upright position (see FIGS. 1 and 8) to a tilted position (see FIG. 19). The bottom surface 110 also includes a curved portion 139 between the wheels 136*a*, 136*b* (shown in FIGS. 10 and 13) defined by a radius preferably in a range of 50 mm to 70 mm, and more preferably about 60 mm. The radius of the curved portion 139 provides a ground clearance zone between the wheels 136*a*, 136*b* and the bottom surface 110.

The base 14 further includes a pair of caster wheels 142*a*, 142*b*, which swivel about the base 14. The caster wheels 142*a*, 142*b* each preferably swivel 360 degrees about the base 14 around a swivel axis to allow the luggage bag 10 to roll in a controlled manner when in the upright position.

Figure 10:
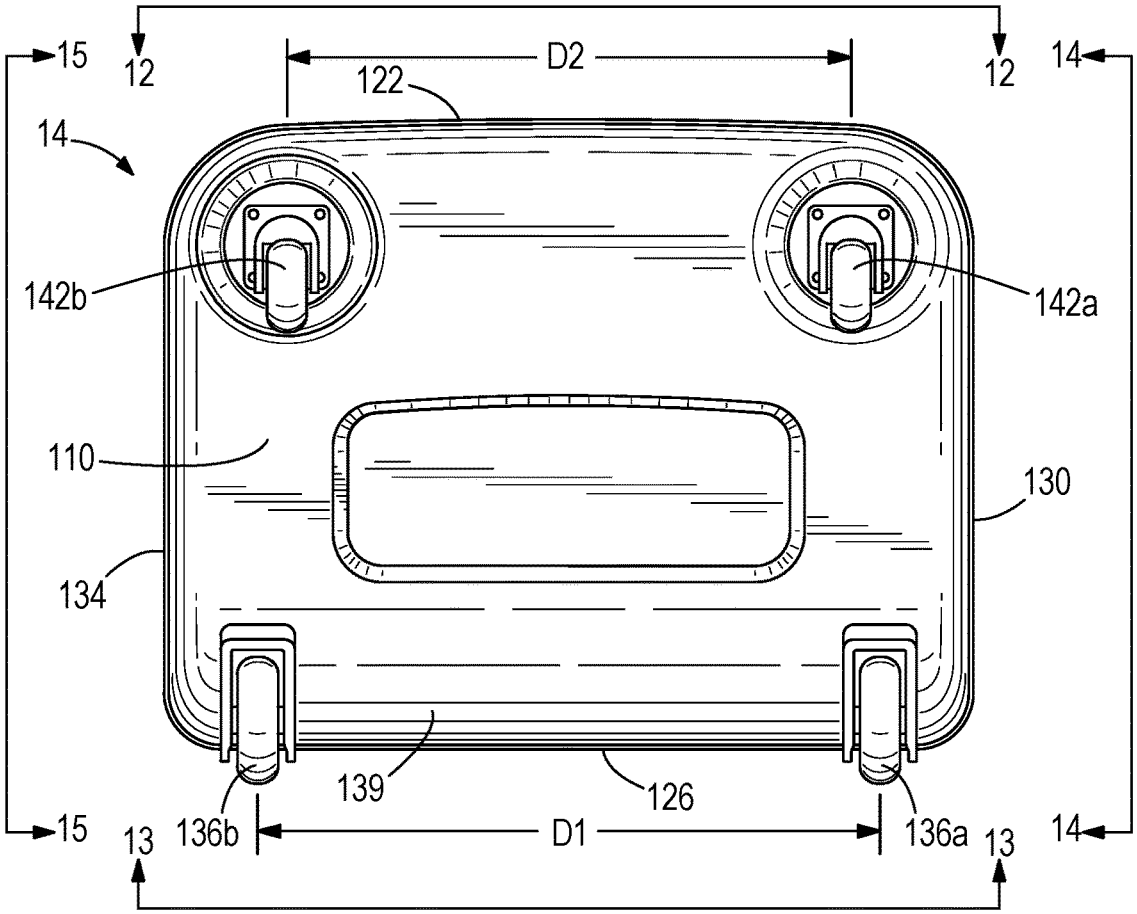
FIG. 10 is a bottom plan view of the rolling collapsible travel luggage bag of FIG. 1, illustrating an external bottom surface of the luggage bag base.
Figure 11:
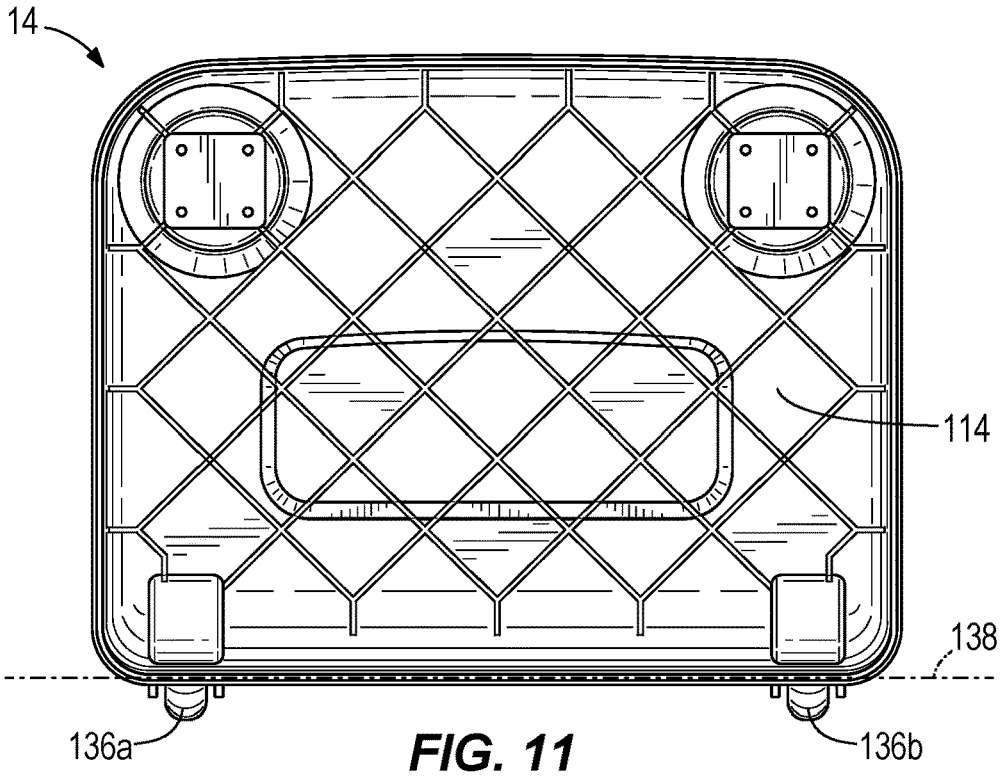
FIG. 11 is a top plan view of an internal bottom surface of the base of FIG. 10.
Figure 12:
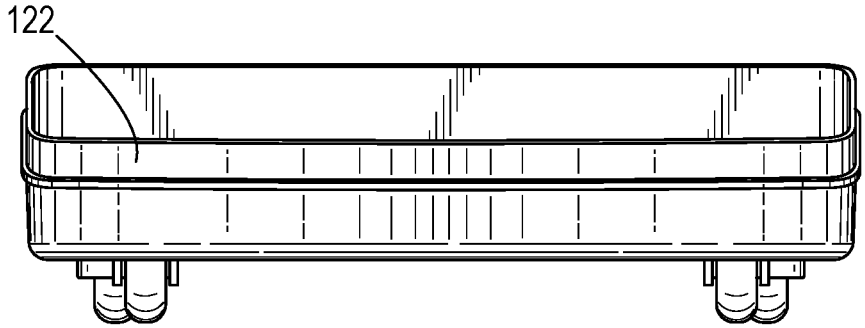
FIG. 12 is a front side view of the base taken along line 12-12 of FIG. 10.
Figure 13:
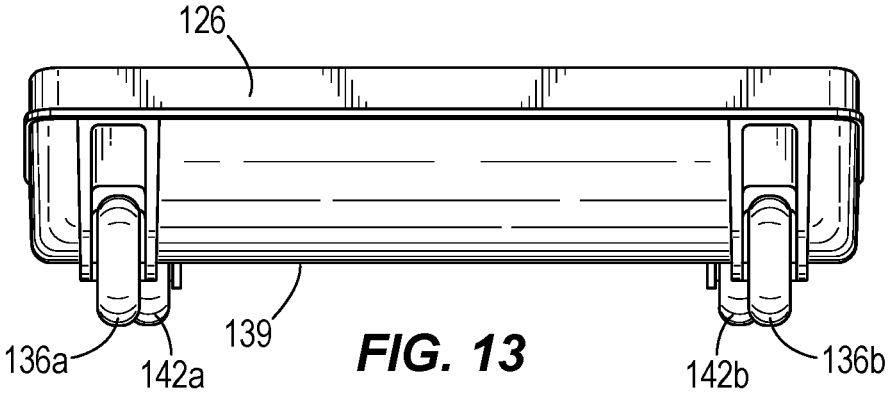
FIG. 13 is a back side view of the base taken along line 13-13 of FIG. 10.

As illustrated in FIG. 10, the wheels 136*a*, 136*b* are preferably separated by a first distance $D_1$ of approximately 330 mm between a point of rotation of each of the wheels 136*a*, 136*b* while the caster wheels 142*a*, 142*b* are preferably separated by a second distance $D_2$ of approximately 300 mm between a swivel axis of each of the wheels 142*a*, 142*b*. In other embodiments, the first and second distances $D_1$, $D_2$ can be any suitable or desired distance, with the first distance $D_1$ generally being greater than the second distance $D_2$. The wheels 136, 142 are positioned in the same plane, i.e., the wheels 136, 142 are positioned to contact a floor or other surface in the same horizontal plane. When the luggage bag 10 is in the upright position, both the non-swivel wheels 136*a*, 136*b* and the swivel wheels 142*a*, 142*b* remain in contact with the floor or other surface on which the luggage bag 10 is located. This contact by all wheels 136, 142 on the base 14 reduces the risk of unintended luggage movement while continuing to allow targeted rolling movement of the luggage bag 10. While the swivel wheels 142 permit directional movement of the luggage bag 10, the non-swivel wheels 136 act as a stop to help inhibit unintended luggage movement, for example if a person or object pushes (or applies a force) on one of the side portions 30, 34.

With reference to FIG. 16, the luggage bag 10 is collapsible to reduce the storage footprint when not in use. The panels of the storage cover 18 fold along folds 42, 42*a* allowing the panels to be collapsed toward and at least partially received in the base 14. As referenced earlier, folds 42 are provided between adjacent or consecutive panels in each of the front, back, first side, and second side portions 22, 26, 30, 34. In addition, folds 42 are provided between panels of each adjacent or consecutive portion 26, 30, 34, such as between adjacent panels in a given panel zone 50. In addition, angled folds 42*a*, which are generally oblique to the base 14, also serve to facilitate collapsing luggage bag 10 toward base 14.

Figure 17:
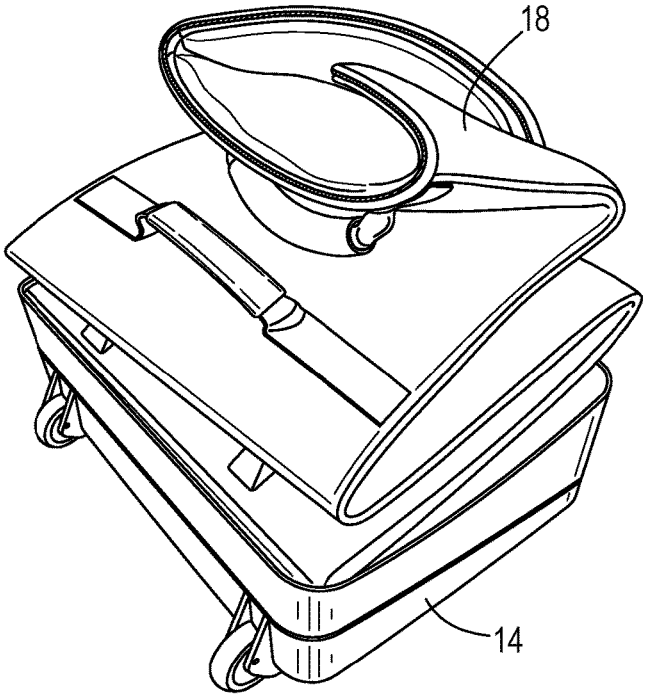
FIG. 17 is a perspective view of the rolling collapsible travel luggage bag of FIG. 1 in a partially collapsed position with a portion of the cover received by a base.

To collapse the luggage bag 10, the connection member 98 is opened such that the front portion 22 is no longer secured to the back, first side, and second side portions 26, 30, 34. The front portion 22 is folded or bent along the folds 42 between panels, and then received in the base 14. The side portions 30, 34 are also folded or bent along angled folds 42*a* towards the base 14. The panel between the base 14 and folds 42*a* is then received by the base 14, followed by the panel on the opposite side of folds 42*a*. With the side portions 30, 34 positioned inward (or toward each other) to contact the back portion 26, if used, the rails 182 disengage from the rail extensions 186, and the remainder of the cover 18 folds along folds 42 and is partially received in the base 14 (see FIG. 17). In other embodiments, the cover 18 may be partially, substantially, or entirely received in the base 14.

Figure 18A:
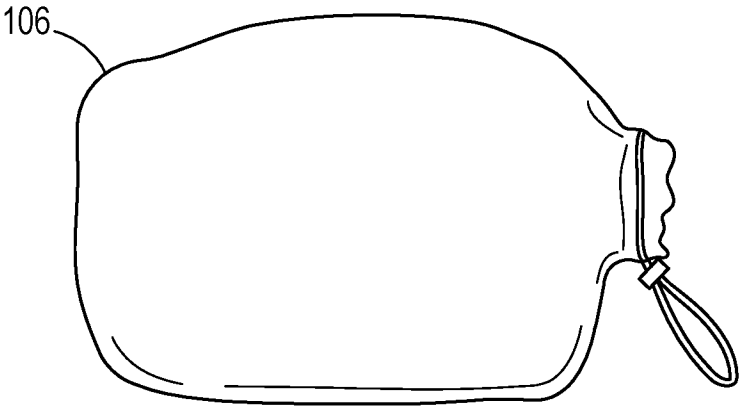
FIG. 18A is a side elevation view of a storage bag containing the luggage bag of FIG. 1 in a collapsed position
Figure 18B:
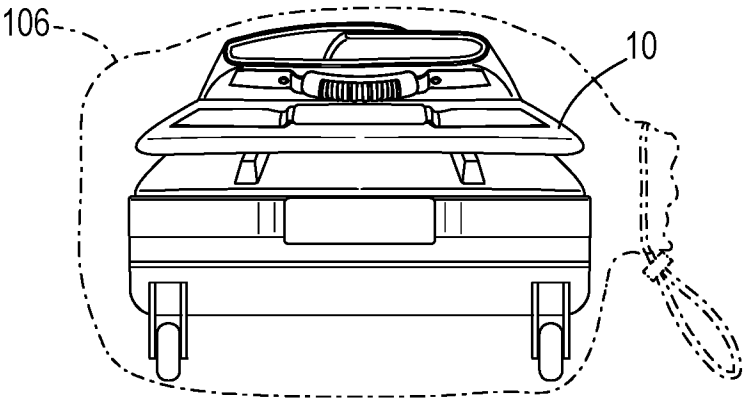
FIG. 18B is another side elevation view of the storage bag of FIG. 18A, with a portion of the storage bag shown in broken lines to illustrate the luggage bag of FIG. 1 in the collapsed position in the bag.

In this collapsed, folded position, the luggage bag 10 itself may be received in a storage bag 106 (see FIGS. 18A-B) for storage until later use. While the disclosed cover 18 remains in the collapsed, folded position by way of the illustrated arrangement of panels and folds, the luggage bag 10 may include additional devices or assemblies to assist in retaining the luggage bag 10 in the collapsed, folded position for orderly storage. For example, in other embodiments, the luggage bag 10 can include a simple strap or other device to maintain the collapsible cover 18 in the collapsed position and avoid an unintentional unraveling of the cover 18 from the collapsed position (for example by an unintended dropping of the collapsed, folded luggage bag 10). Such a simple strap may include a single strap or bungee-like cord that extends around a portion of the base 14 and cover 18 to assist in maintaining the cover in the collapsed, folded position.

Figure 19:
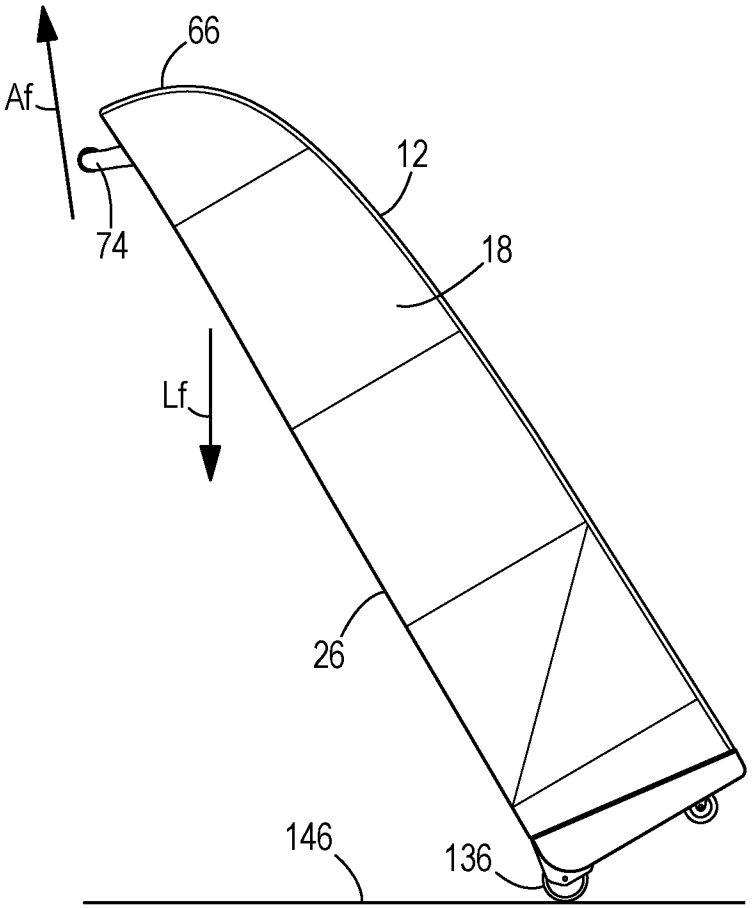
FIG. 19 is a schematic view of the rolling collapsible travel luggage bag of FIG. 1 in a tilted position, illustrating certain forces on the luggage.

Referring now to FIG. 19, in a preferred embodiment the luggage bag 10 reduces strain on a user when in a tilted position or pivot position for rolling movement on the wheels 136. To reach the illustrated tilted position, a user pivots the luggage bag 10 about the axis of rotation 138 of wheels 136, for example with rolling handle 74. During the pivot, the front wall 122 end of the base 14 lifts away from the ground or surface 146. In addition, all swivel wheels 142 are lifted away from contact with the ground 146. The user then pulls on the handle 74, and the luggage bag 10 rolls on wheels 136. The positioning of the handle 74 on the back portion 26 advantageously reduces strain on a wrist, hand, and arm of the user pulling (or applying a pulling force to) the luggage bag 10 as the handle 74 location is further away or offset from the wheels 136 in a pulling direction, reducing the force $A_f$ applied by the user to overcome the load force $L_f$ of the luggage bag 10. In addition, a portion of the luggage bag 10 rests on the hand, wrist, and/or arm of the user as the user pulls the luggage bag 10 in the tilted position, reducing the application of luggage weight to a user's hand, wrist, and arm.

A method of manufacturing the luggage bag 10 includes providing the base 18, and coupling a first wheel 136*a*, a second wheel 136*b*, a third wheel 142*a*, and a fourth wheel 142*b* to the base 18. The method further includes attaching or securing the back, first side, and second side portions 26, 30, 34 to the base 18. In addition, the method includes attaching or securing the front portion 22 to the base 18. The method also includes removably connecting the front portion 22 to the back, first side, and second side portions 26, 30, 34 by the connection member 98. It should be appreciated that the disclosed method of manufacturing is illustrative, and the method may be completed in any suitable order or sequence of steps. In addition, two or more manufacturing steps may be completed concurrently.

The rolling collapsible travel luggage bag 10 provides advantages over known luggage in the art. Among them, utilizing an improved wheel arrangement of non-swivel wheels 136 combined with swivel wheels 142 that all remain in contact with the floor or other surface when the luggage bag 10 is in the upright position reduces the risk of unintended luggage movement while continuing to allow targeted rolling movement of the luggage bag 10 and reducing its overall weight. In addition, the positioning of the handle 74 also reduces user strain when the luggage bag 10 is rolled in a tilted position. Further, the user has unobstructed access to the interior chamber 102 defined by the luggage bag 10 through a butterfly opening, which additionally facilitates insertion and removal of large and/or bulky items. Moreover, the panels that define the front, back, first side, and second side portions 22, 26, 30, 34 fold along a plurality of folds 42 that separate adjacent panels. By folding, the portions 22, 26, 30, 34 cooperate to collapse into the base 14, reducing the storage footprint of the luggage bag 10 when not in use.

Clause 1. A rolling luggage bag comprising:

a cover fixedly coupled to a base, the base including a first side opposite a second side and a bottom face extending there between; wherein the cover comprises a plurality of panels, arranged in a direction away from the base, wherein the plurality of panels comprises a first panel zone proximate the base, a second panel zone adjacent the first panel zone in a direction away from the base, a third panel zone adjacent the second panel zone in a direction away from the base, a fourth panel zone adjacent the third panel zone in a direction away from the base, and a fifth panel zone adjacent the fourth panel zone in a direction away from the base; a first wheel and a second wheel coupled to the base, the first and second wheels configured to rotate about an axis of rotation and separated by a first distance along the axis of rotation, at least a portion of each of the first and second wheels projecting from the first side and from the bottom face; a third wheel and a fourth wheel coupled to the bottom face, the third and fourth wheels configured to independently swivel about a respective swivel axis and separated by a second distance extending between the swivel axes; wherein the rolling luggage bag further comprises a plurality of rail members positioned in the second panel zone, and a plurality of rail extensions positioned on the base, wherein when the rolling luggage bag is in the upright position each rail member engages one of the pluralities of rail extensions to form a bumper that extends from the base along a portion of the cover.

Clause 2. The rolling luggage bag of clause 1, wherein the first distance is greater than the second distance.

Clause 3. The rolling luggage bag of clause 1, wherein the rolling luggage bag is configured to be movable along the surface through rotation of the first, second, third, and fourth wheels.

Clause 4. The rolling luggage bag of clause 1, wherein the rolling luggage bag is pivotable about the axis of rotation into a titled position such that the first and second wheels are in rolling contact with the surface, and the third and fourth wheels are removed from rolling contact with the surface, and wherein the rolling luggage bag is movable along the surface in the tilted position.

Clause 5. The rolling luggage bag of clause 1, wherein when the rolling luggage bag is in an upright position, the first, second, third, and fourth wheels all contact a surface the rolling luggage bag stands on.

Clause 6. The rolling luggage bag of clause 1, wherein the panels of the first panel zone are rectangular in shape.

Clause 7. The rolling luggage bag of clause 1, wherein the panels of second panel zone are square in shape, wherein the square shape is defined by two separate triangular panels having an angled fold there between.

Clause 8. The rolling luggage bag of clause 1, wherein the panels of the third, fourth, and fifth panel zones are trapezoidal in shape.

Clause 9. The rolling luggage bag of clause 1, wherein the panels of the first panel zone have a greater stiffness than the panels of the second panel zone.

Clause 10. The rolling luggage bag of clause 1, wherein the first panel zone has a first handle on a side of the cover aligned with the first side of the base.

Clause 11. The rolling luggage bag of clause 1, wherein the second panel zone has a storage pocket.

Clause 12. The rolling luggage bag of clause 1, wherein the fourth panel zone has a plurality of second handles.

Clause 13. A collapsible luggage bag comprising: a back portion connected to a first side portion and a second side portion; a front flap removably connected to the first side portion, the second side portion, and the back portion by a connection member; a base connected to the back portion, the first side portion, the second side portion, and the front flap; wherein the base is fixedly connected to the back portion; wherein the back portion, first side portion, second side portion, and front flap, comprise a plurality of panels, wherein the plurality of panels comprises a first panel zone proximate the base, a second panel zone adjacent the first panel zone in a direction away from the base, a third panel zone adjacent the second panel zone in a direction away from the base, a fourth panel zone adjacent the third panel zone in a direction away from the base, and a fifth panel zone adjacent the fourth panel zone in a direction away from the base, wherein each of the panel zones extends around a circumference defined by a portion of the back portion, first side portion, second side portion, and the front flap; wherein the second panel zone has a storage pocket, wherein the fourth panel zone has a plurality of second handles, wherein the first and second side portions pivot away from each other about respective folds between the respective side portion and the back portion when the front flap is at least partially removed; a first wheel and a second wheel coupled to the base, the first and second wheels configured to rotate about an axis of rotation and separated by a first distance along the axis of rotation, at least a portion of each of the first and second wheels projecting from the first side and from a bottom face; and a third wheel and a fourth wheel coupled to the bottom face, the third and fourth wheels configured to independently swivel about a respective swivel axis and separated by a second distance extending between the swivel axes; wherein the rolling luggage bag further comprises a plurality of rail members positioned in the second panel zone, and a plurality of rail extensions positioned on the base, wherein when the rolling luggage bag is in the upright position each rail member engages one of the pluralities of rail extensions to form a bumper that extends from the base along a portion of the cover.

Clause 14. The collapsible luggage bag of clause 13, wherein the second panel zone includes an arcuate portion of the front flap.

Clause 15. The collapsible luggage bag of clause 13, wherein when the rolling luggage bag is in an upright position, the first, second, third, and fourth wheels all contact a surface the rolling luggage bag stands on.

Clause 16. The collapsible luggage bag of clause 13, wherein the panels of the first panel zone are rectangular in shape.

Clause 17. The collapsible luggage bag of clause 13, wherein the panels of second panel zone are square in shape, wherein the square shape is defined by two separate triangular panels having an angled fold there between.

Clause 18. The collapsible luggage bag of clause 13, wherein the panels of the third, fourth, and fifth panel zones are trapezoidal in shape.

Clause 19. The collapsible luggage bag of clause 13, wherein the panels of the first panel zone have a greater stiffness than the panels of the second panel zone.

Clause 20. The collapsible luggage bag of clause 13, wherein the connection member is a zipper.

Clause 21. The collapsible luggage bag of clause 13, wherein the zipper includes at least two sliders.

Clause 22. The collapsible luggage bag of clause 13, wherein the front side of the base is on the same side of the luggage bag as the front flap, and the back side of the base is on the same side of the luggage bag as the back portion.

Clause 23. The collapsible luggage bag of clause 13, wherein the collapsible luggage bag is pivotable about the axis of rotation into a titled position such that the first and second wheels are in rolling contact with the surface, and the third and fourth wheels are removed from rolling contact with the surface, and wherein the collapsible luggage bag is movable along the surface in the tilted position.

Clause 24. The collapsible luggage bag of clause 13, wherein the second panel zone has a storage pocket.

Clause 25. The collapsible luggage bag of clause 13, wherein the fourth panel zone has a plurality of second handles.

The invention claimed is:

1. A rolling luggage bag comprising:

a cover fixedly coupled to a base, the base including a first side opposite a second side and a bottom face extending there between;

wherein the cover comprises a plurality of panels, arranged in a direction away from the base, wherein the plurality of panels comprises a first panel zone proximate the base, a second panel zone adjacent the first panel zone in a direction away from the base, a third panel zone adjacent the second panel zone in a direction away from the base, a fourth panel zone adjacent the third panel zone in a direction away from the base, and a fifth panel zone adjacent the fourth panel zone in a direction away from the base;

a first wheel and a second wheel coupled to the base, the first and second wheels configured to rotate about an axis of rotation and separated by a first distance along the axis of rotation, at least a portion of each of the first and second wheels projecting from the first side and from the bottom face;

a third wheel and a fourth wheel coupled to the bottom face, the third and fourth wheels configured to independently swivel about a respective swivel axis and separated by a second distance extending between the swivel axes;

wherein the rolling luggage bag further comprises a plurality of rail members positioned in the second panel zone, and a plurality of rail extensions positioned on the base;

wherein each of the plurality of rail members define a channel, wherein the channel may further be defined by an elongated portion of each of the plurality of rail members;

wherein the elongated portion crosses a fold between the first and second panel zones;

wherein each of the plurality of rail extensions includes a projection, wherein the projection is any width that is complementary to a corresponding rail member in order to facilitate engagement between the rail member and the projection;

wherein the projection is removably received by the elongated portion of the channel of the corresponding rail member;

wherein when the rolling luggage bag is folded and in a collapsed position, each rail extension is separated from each rail member, the projection does not engage with the channel, and the disengagement facilitates the collapsibility of the cover; and wherein when the rolling luggage bag is unfolded and in an upright position, the plurality of rail members and the plurality of rail extensions are contiguous, and each elongated portion engages one of the projections to form a continuous bumper that extends from the rail extensions on the base along the rail members on a portion of the cover.

2. The rolling luggage bag of claim 1, wherein the first distance is greater than the second distance.

3. The rolling luggage bag of claim 1, wherein the rolling luggage bag is configured to be movable along a surface through rotation of the first, second, third, and fourth wheels.

4. The rolling luggage bag of claim 3, wherein the rolling luggage bag is pivotable about the axis of rotation into a tilted position such that the first and second wheels are in rolling contact with the surface, and the third and fourth wheels are removed from rolling contact with the surface, and wherein the rolling luggage bag is movable along the surface in the tilted position.

5. The rolling luggage bag of claim 4, wherein when the rolling luggage bag is in the upright position, the first, second, third, and fourth wheels all contact the surface the rolling luggage bag stands on.

6. The rolling luggage bag of claim 1, wherein the panels of the first panel zone are rectangular in shape.

7. The rolling luggage bag of claim 1, wherein the panels of second panel zone are square in shape, wherein the square shape is defined by two separate triangular panels having an angled fold there between.

8. The rolling luggage bag of claim 1, wherein the panels of the third, fourth, and fifth panel zones are trapezoidal in shape.

9. The rolling luggage bag of claim 1, wherein the panels of the first panel zone have a greater stiffness than the panels of the second panel zone.

10. The rolling luggage bag of claim 1, wherein the first panel zone has a first handle on a side of the cover aligned with the first side of the base.

11. The rolling luggage bag of claim 10, wherein the second panel zone further comprises a storage pocket and the fourth panel zone comprises a plurality of second handles.

12. A collapsible luggage bag comprising:

a back portion connected to a first side portion and a second side portion;

a front flap removably connected to the first side portion, the second side portion, and the back portion by a connection member;

a base connected to the back portion, the first side portion, the second side portion, and the front flap;

wherein the base is fixedly connected to the back portion;

wherein the back portion, first side portion, second side portion, and front flap, comprise a plurality of panels, wherein the plurality of panels comprises a first panel zone proximate the base, a second panel zone adjacent the first panel zone in a direction away from the base, a third panel zone adjacent the second panel zone in a direction away from the base, a fourth panel zone adjacent the third panel zone in a direction away from the base, and a fifth panel zone adjacent the fourth panel zone in a direction away from the base, wherein each of the panel zones extends around a circumference defined by a portion of the back portion, first side portion, second side portion, and the front flap;

wherein the second panel zone has a storage pocket, wherein the fourth panel zone has a plurality of handles, wherein the first and second side portions pivot away from each other about respective folds between the respective side portion and the back portion when the front flap is at least partially removed;

a first wheel and a second wheel coupled to the base, the first and second wheels configured to rotate about an axis of rotation and separated by a first distance along the axis of rotation, at least a portion of each of the first and second wheels projecting from the first side and from a bottom face; and a third wheel and a fourth wheel coupled to the bottom face, the third and fourth wheels configured to independently swivel about a respective swivel axis and separated by a second distance extending between the swivel axes;

wherein the rolling luggage bag further comprises a plurality of rail members positioned in the second panel zone, and a plurality of rail extensions positioned on the base;

wherein each of the plurality of rail members define a channel, wherein the channel may further be defined by an elongated portion of each of the plurality of rail members;

wherein the elongated portion crosses a fold between the first and second panel zones;

wherein each of the plurality of rail extensions includes a projection, wherein the projection is any width that is complementary to a corresponding rail member in order to facilitate engagement between the rail member and the projection:

wherein the projection is removably received by the elongated portion of the channel of the corresponding rail member;

wherein when the rolling luggage bag is folded and in the collapsed position, each rail extension is separated from each rail member, the projection does not engage with the channel, and the disengagement facilitates the collapsibility of the cover; and wherein when the rolling luggage bag is unfolded and in an upright position, the plurality of rail members and the plurality of rail extensions are contiguous, and each elongated portion engages one of the projections to form a continuous bumper that extends from the rail extensions on the base along the rail members on a portion of the cover.

13. The collapsible luggage bag of claim 12, wherein the second panel zone includes an arcuate portion of the front flap.

14. The collapsible luggage bag of claim 12, wherein when the rolling luggage bag is in the upright position, the first, second, third, and fourth wheels all contact a surface the rolling luggage bag stands on.

15. The collapsible luggage bag of claim 14, wherein the collapsible luggage bag is pivotable about the axis of rotation into a tilted position such that the first and second wheels are in rolling contact with the surface, and the third and fourth wheels are removed from rolling contact with the surface, and wherein the collapsible luggage bag is movable along the surface in the tilted position.

16. The collapsible luggage bag of claim 12, wherein the panels of second panel zone are square in shape, wherein the square shape is defined by two separate triangular panels having an angled fold there between.

17. The collapsible luggage bag of claim 12, wherein the panels of the third, fourth, and fifth panel zones are trapezoidal in shape.

18. The collapsible luggage bag of claim 12, wherein the panels of the first panel zone have a greater stiffness than the panels of the second panel zone.

19. The collapsible luggage bag of claim 12, wherein the connection member is a zipper, and the zipper includes at least two sliders.

* * * * *